US007407406B2

(12) United States Patent
Arlitt et al.

(10) Patent No.: US 7,407,406 B2
(45) Date of Patent: Aug. 5, 2008

(54) CONNECTOR TAP-OFF ARRANGEMENT FOR CONTINUOUS CONDUCTORS

(75) Inventors: Uwe Arlitt, Leopoldshöhe (DE); Paulo Russo, Lage (DE); Rainer Schulze, Detmold (DE); John Witt, Detmold (DE); Günter Lucht, Horn-Bad Meinberg (DE); Joachim Bury, Detmold (DE); Torsten Diekmann, Leopoldshöhe (DE); Andreas Wedler, Detmold (DE); Thomas Salomon, Gütersloh (DE); Thomas Pieper, Geseke (DE)

(73) Assignee: Weidmüller Interface GmbH & Co. KG, Detmold (DE)

( * ) Notice: Subject to any disclaimer, the term of this patent is extended or adjusted under 35 U.S.C. 154(b) by 71 days.

(21) Appl. No.: 11/519,250

(22) Filed: Sep. 12, 2006

(65) Prior Publication Data

US 2007/0066121 A1 Mar. 22, 2007

(30) Foreign Application Priority Data

Sep. 17, 2005 (DE) ..... 20 2005 014 718 U

(51) Int. Cl.
*H01R 4/24* (2006.01)
*H01R 4/26* (2006.01)
*H01R 11/20* (2006.01)

(52) U.S. Cl. ..... 439/404; 439/712

(58) Field of Classification Search ..... 439/404, 439/405, 409, 410, 717, 709, 712, 400
See application file for complete search history.

(56) References Cited

U.S. PATENT DOCUMENTS 5,062,024 A * 10/1991 Hennemann ..... 361/823
5,637,011 A 6/1997 Meyerhoefer et al.
6,065,996 A * 5/2000 Bechaz et al. ..... 439/409
6,238,233 B1 * 5/2001 Drexler et al. ..... 439/409
6,811,430 B1 11/2004 Carrico et al.
7,234,961 B2 * 6/2007 Arlitt et al. ..... 439/410

FOREIGN PATENT DOCUMENTS

| | | | |
|---|---|---|---|
| DE | 297 06 750 | U1 | 7/1997 |
| DE | 297 08 222 | U1 | 10/1998 |
| DE | 198 54 200 | A1 | 6/2000 |
| DE | 199 03 030 | C1 | 5/2001 |
| DE | 101 63 809 | A1 | 7/2003 |
| EP | 0232 440 | | 8/1987 |
| EP | 0 271 413 | | 6/1988 |
| EP | 0 690 523 | A1 | 1/1996 |
| WO | WO 02/11249 | A1 | 2/2002 |

* cited by examiner

*Primary Examiner*—Hae M Hyeon
(74) *Attorney, Agent, or Firm*—Lawrence E Laubscher, Sr.; Lawrence E Laubscher, Jr.

(57) ABSTRACT

A connector arrangement for tapping off current from a plurality of insulated input conductors includes a rectangular base member having a horizontal planar upper surface provided with a plurality of parallel seats receiving the insulated conductors, a frame mounted on the base member for supporting a plurality of terminal blocks for vertical displacement over the seats, each terminal block including an insulation piercing contact extending downwardly therefrom, and an eccentric disk arrangement for displacing each terminal block relative to the frame member between an elevated position spaced above the associated conductor seat and a lowered position in which the contact penetrates the insulation layer and engages the conductor, thereby to transmit current to an output conductor via the insulation-piercing conductor, a bus bar, and a tap-off terminal.

26 Claims, 28 Drawing Sheets

CONNECTOR TAP-OFF ARRANGEMENT FOR CONTINUOUS CONDUCTORS

CROSS REFERENCE TO RELATED APPLICATION

This application is a companion application to the Arlitt et al application Ser. No. 11/518,771 filed Sep. 11, 2006 (now U.S. Pat. No. 7,234,961 of Jun. 26, 2007, and the Wedler et al application Ser. No. 11/974,830 filed Oct. 16, 2007.

BACKGROUND OF THE INVENTION

1. Field of the Invention

A connector arrangement is provided for tapping off current from a plurality of insulated input conductors and for supplying the same to a plurality of output conductors, including a rectangular base member having a horizontal planar upper surface provided with a plurality of parallel seats receiving the insulated conductors, a frame mounted on the base member for supporting a plurality of terminal blocks for vertical displacement over the seats, each terminal block including an insulation piercing contact extending downwardly therefrom, and an eccentric disk arrangement for displacing each terminal block relative to the frame member between an elevated position spaced above the associated conductor seat, and a lowered position in which the contact penetrates the insulation layer and engages the conductor.

2. Description of Related Art

This kind of connection system is known from DE 297 08 222 U1. The connection system shown in that reference is used—just as the connection system of the present invention—to make electricity tap-off branches from a plurality of continuous conductors without having to cut through the continuous conductors. For this purpose, a plurality of groove-like seats are provided on a base plate into which seat one can insert a flat cable or a plurality of electrical conductors that are parallel with respect to each other. Then an upper part is put on in order to slacken the conductors or the flat cable. Upon this preassembled unit, which is provided with separating walls, one then locks clamp-like bodies in a pivotal motion, which bodies in each case are provided with an insulation-penetrating contact that is connected via a bus bar with, in each case, two resilient contacts for connection with output conductors. In this way, one can make in each case two branches on each conductor without having to separate the continuous conductors.

It is also known that one can arrange conductor connection discs on a shaft in a rotatable manner upon a bottom plate. This design did not work satisfactorily, because the conductors must be inserted sideways so that the arrangement is not suitable for assembly upon already-installed continuous cables.

The present invention therefore starts with the typical state of the art and seeks to simplify said state of the art with respect to its design structure, whereby a compact structure with ease of operation is achieved.

SUMMARY OF THE INVENTION

Accordingly, a primary object of the present invention is to provide a connector arrangement for supplying to a plurality of output conductors electrical current that is tapped off current from a plurality of continuous insulated conductors, including a base member having a plurality of parallel longitudinal seats for supporting the insulated conductors, a rigid hollow rectangular frame mounted on the base member to enclose the space above the seats, a plurality of terminal blocks connected within the frame for vertical displacement above the seats, respectively, said terminal blocks containing downwardly extending insulation-piercing contacts, respectively, and displacement means for displacing the terminal blocks downwardly relative to the frame to cause the insulation layers of the insulated conductors to be pierced by the contacts. The insulation-piercing contact means are connected by internal bus bar means with output terminals that that supply the tapped-off current to the output conductors connected thereto.

According to another object of the invention, the frame and terminal block assembly is mounted on the base member by snap fastener means provided on integral posts that extend upwardly from the base member, whereby upon downward displacement of the assembly relative to the base member, the fastener means on the integral posts cooperate with corresponding fastener surfaces on the frame. In a second embodiment, the frame includes pivot lug means that extend from one end of the frame for engagement with corresponding pivot openings contained in the base member, whereby in order to fasten the frame and terminal block assembly to the base member, the frame and terminal block assembly is pivoted downwardly about the pivot lug and opening from an inclined upper position toward a horizontal position above and parallel with the base member, thereby to cause engagement between fastener means carried by integral posts on the base member and corresponding fastener surfaces at the other end of the frame.

The present invention provides a connection system for tapping off electricity from a plurality of continuous electrical conductors, in particular, a section of cable from which the outer sheath has been stripped, with a base plate provided with a plurality of parallel seats arranged next to each other for the purpose of receiving the conductors of the cable from which the sheathing has been stripped, section by section; a connection module that is arranged on the bottom plate and that preferably can be supported by a modular frame having several receiving chambers for f receiving movably arranged terminal blocks in them with housings made of insulating material, where the terminal blocks have at least one insulation-penetrating contact that is directed at the bottom plate and that serves for contacting one of the conductors, together with at least one branch connection, in particular, for output tap-off conductors.

As regards design, the arrangement is further simplified when, compared to the state of the art, the invention uses tool-free connectable insulation-piercing contacts, in particular, contacts for wiring purposes. The module frame is well suited for absorbing the force, especially during wiring. In the process, the connection module as such already creates a unit that can be pre-assembled by the manufacturer, and that unit, in itself, already absorbs the major wiring forces without excessively stressing the bottom plate. It is thus possible in a simple manner to contact both the continuous conductors and the branching conductors (at any rate, when one uses direct plug contacts). As a result, there is no need to insert individual terminal blocks, although each of the conductors can be wired individually.

The continuous insulated conductors, for instance, can be the continuous conductors of a flat cable—for example, a round cable—whose cable sheath was removed in the area of the connection system, whereby the continuous conductors in this sheath-stripped section are inserted in the seats of the bottom plate. For contacting purposes, one then merely needs to put on the terminal blocks, to displace them toward the engaged position, and then to insert the conductor ends of the output tap-off conductors. In this way, one can also quickly and subsequently assemble a output conductor to an already-installed cable.

Preferably, the terminal blocks, and thus especially also the insulation-penetrating contacts arranged thereupon, are guided in a purely vertically movable manner in the respective chambers so as to ensure a clearly defined piercing contact normal to the axis of the conductors. In this way, one can advantageously avoid pivotal movement of the contacts during the severing of the insulation layer of the conductor.

Preferably, actuation devices are associated with the terminal blocks for the purpose of movement, in particular, the vertical displacement of the terminal blocks in their respective chambers. In this manner, the terminal blocks are displaced simultaneously as a group in their respective module chambers; this ensures large-surface sliding bearing and defined guidance of the IDC contacts during the contacting of the conductors. Here, it is particularly advantageous when the actuation devices are made as eccentric disks because the latter facilitates high force transmission in a narrow space.

BRIEF DESCRIPTION OF THE DRAWINGS

Other objects and advantages of the invention will become apparent from a study of the following specification, when viewed in the light of the accompanying drawing, in which.

DETAILED DESCRIPTION OF THE INVENTION

Figure 1:
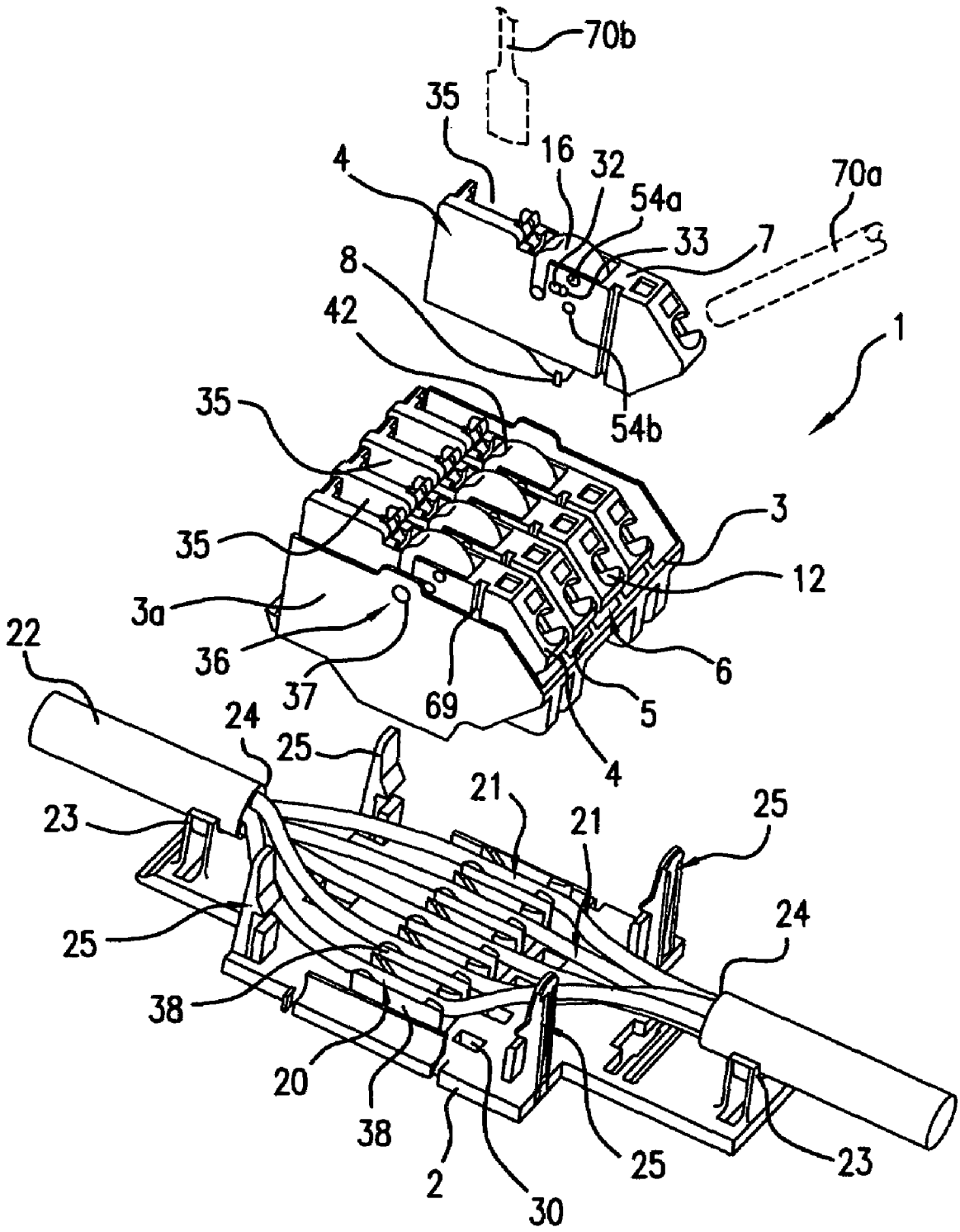
FIG. 1 is an exploded view of a first embodiment of the connector arrangement of the present invention.
Figure 2A:
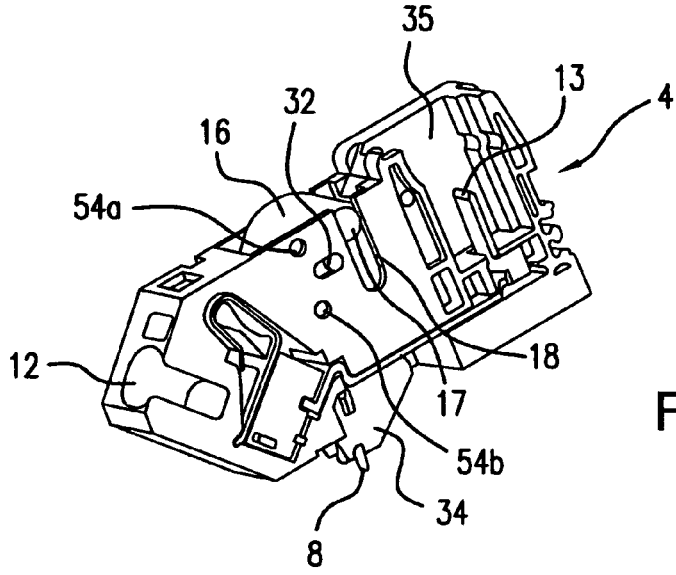
FIG. 2*a* is a perspective rear view of the terminal block of FIG. 1.
Figure 2B:
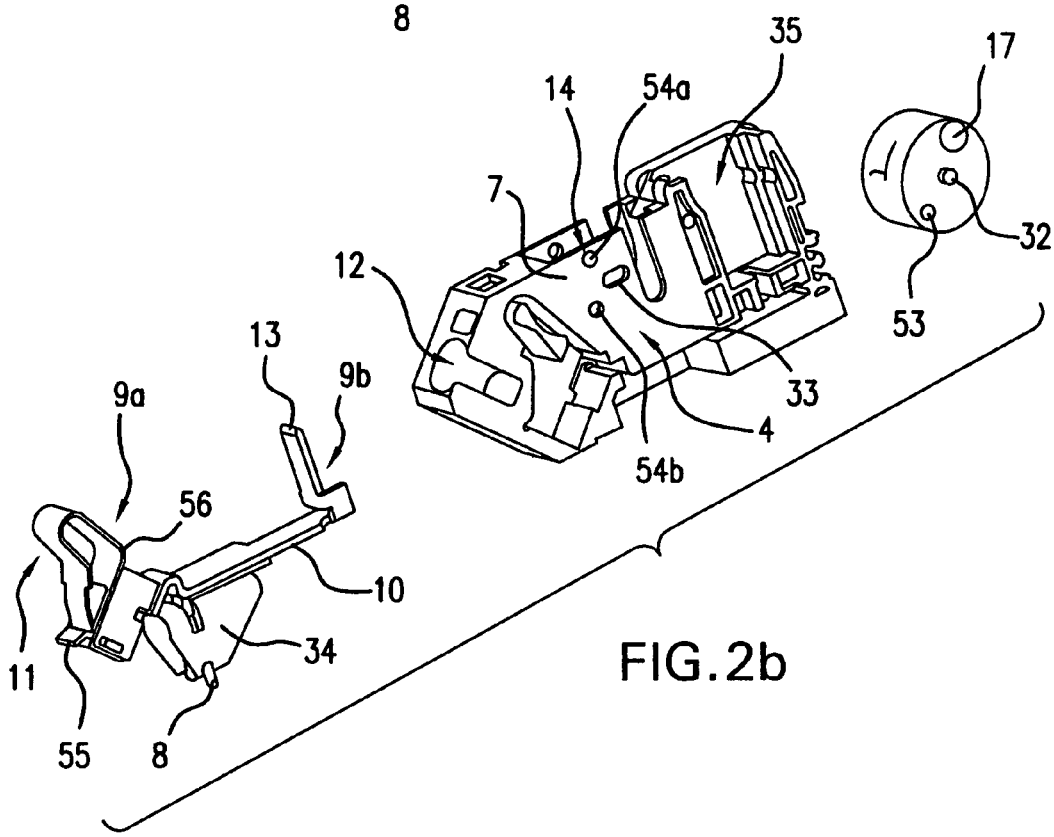
FIG. 2*b* is an exploded view of the terminal block of FIG. 2*a;*
Figure 3:
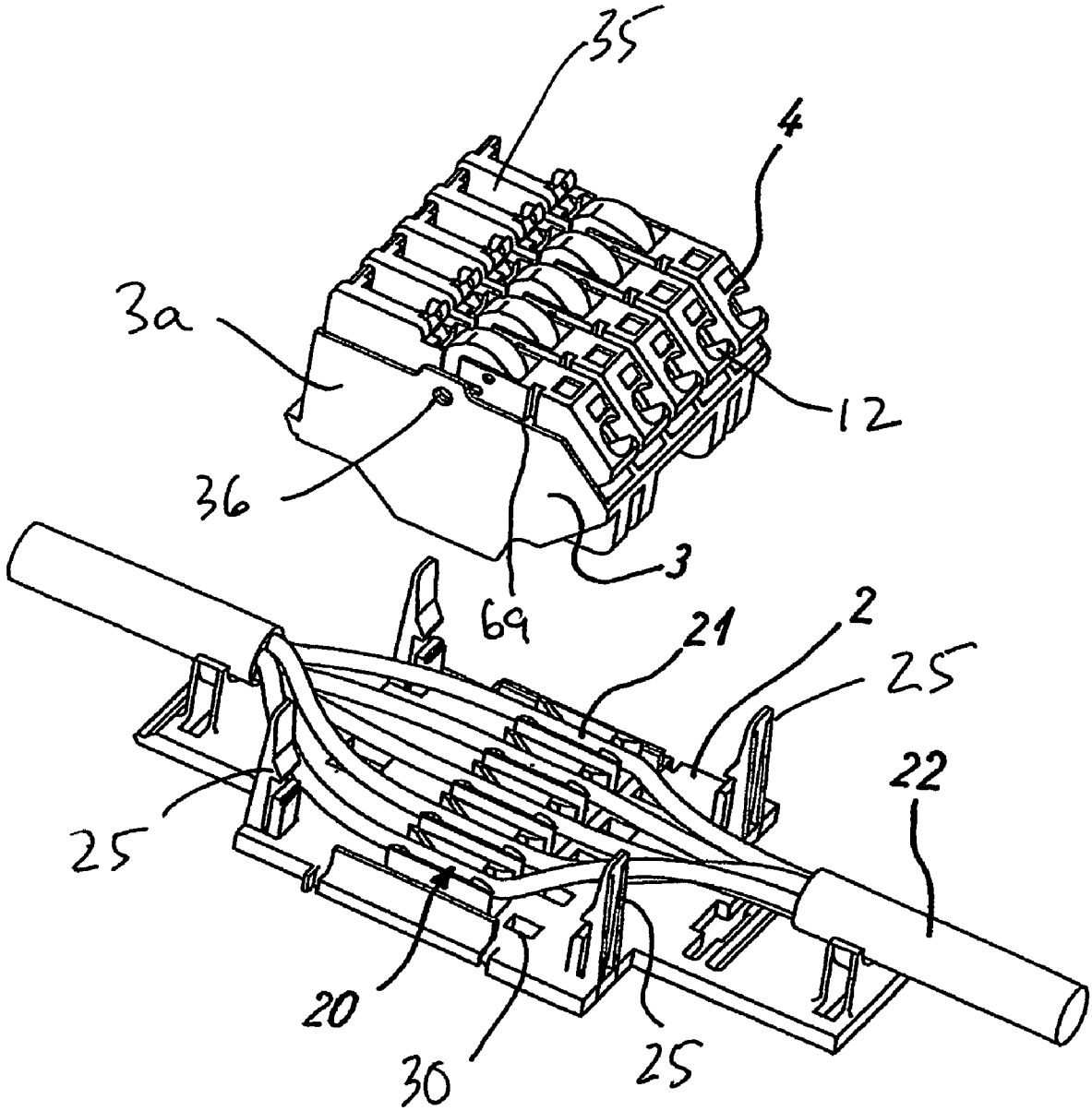
FIG. 3 is an exploded view illustrating the manner of mounting the support frame assembly upon the base member.
Figure 4:
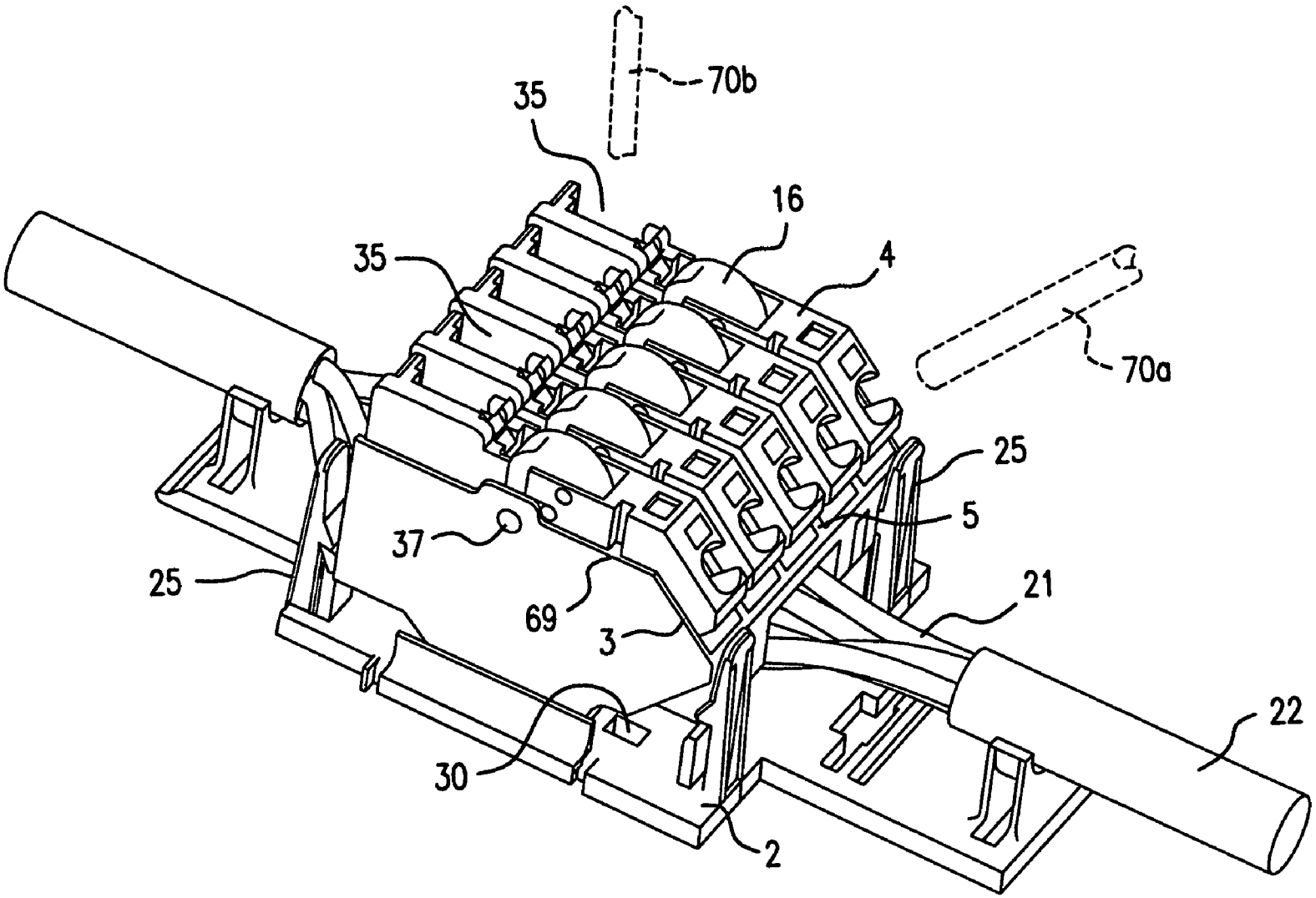
FIGS. 4 and 5 are corresponding perspective views illustrating the frame mounted on the base member with the terminal blocks in their elevated inoperable position and lowered operable insulation-piercing position, respectively.
Figure 5:
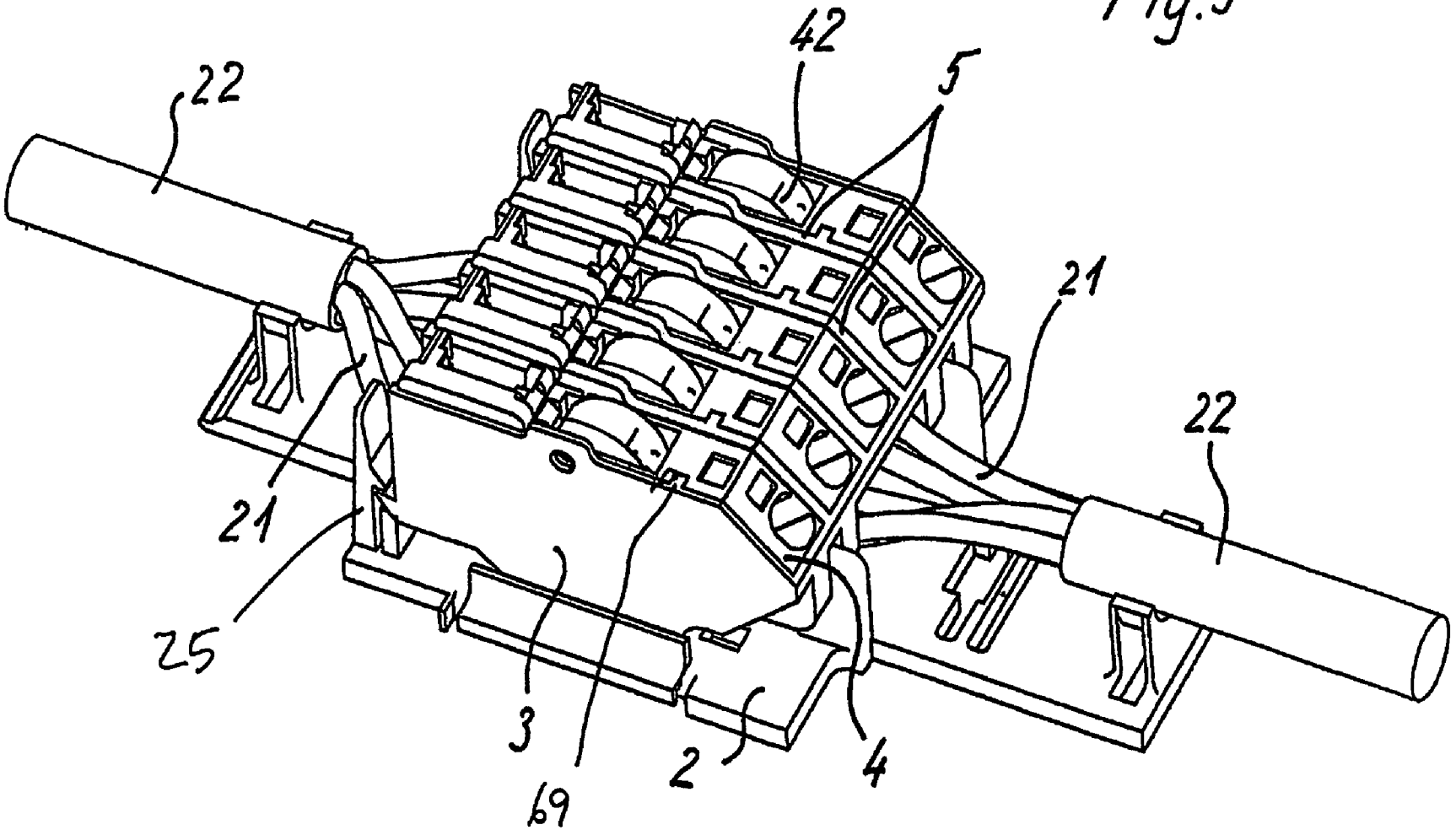

Referring first more particularly to FIGS. 1, 2*a*, and 2*b*, the connector tap-off arrangement 1 of the present invention includes a base member 2 that supports a rigid hollow rectangular frame 3 that is formed from a suitable electrically insulating material and that contains a plurality of parallel partition walls 5 that define a plurality of chambers 6 that are open at their upper and lower ends and within a plurality of terminal blocks 4 are respectively arranged for vertical movement as guided by rib and slot means 69. The apparatus is operable to tap off electrical current from a plurality of insulated conductors 21 of a cable 22 that are exposed upon the removal of a section of the cable sheath, thereby to define a pair of cable sheath ends 24. The cable is supported at each end of the base member 2 by integral cable support means 23, and the individual insulated conductors are mounted in separate longitudinally extending conductor seats 20 that are integral with the base member. As will be explained in greater detail below, when the frame 3 is mounted on the base member 2 as shown in FIGS. 3 and 4, eccentric disks 16 on the terminal blocks 4 are operated to displace the terminal blocks downwardly relative to the frame, thereby to effect piercing of the insulation layers on the conductors 21 by a piercing contacts 8, on the terminal blocks, whereby electrical current is tapped off from the conductors 21 and supplied to output conductors 70*a* and 70*b* connected with the various terminal blocks 4.

As shown in FIGS. 2*a* and 2*b*, each of the terminal blocks 4 includes a terminal block hollow housing 7 that is formed from a suitable electrically insulating synthetic plastic material, and within which is mounted a conductive bus bar 10. At one end, the bus bar 10 is connected with the insulation-piercing fork contact 8 that is connected with first output contact means 9*a* in the form of a resilient contact 11. At its other end, the bus bar 10 is connected with the second output contact means 9*b*, which comprises a generally-vertical plug contact 13. The terminal body 7 has a first access opening 12 for receiving the bare end of an output conductor 70*a* that engages the resilient contact 11, and the other end the terminal body contains a second access opening 35 for receiving the plug connector 65 of a second output conductor 70*b*. Thus, as will be described in greater detail below, when a given insulation-piercing contact 8 pierces the insulation layer of one of the conductors 21 to engage the conductor thereof, electrical current is transmitted both to the first output conductor 70*a* via the resilient contact means 11, and to the second output conductor 70*b* via the bus bar 10, the plug contact 13, and the plug connector 65. As is known in the art, the resilient contact 11 comprises a reversely bent resilient portion 56 terminating in an end extremity 55 that is adapted to engage the bare conductor end of the output conductor 70*a* that is inserted via opening 12. In order to stabilize and support the insulation-piercing contact 8 relative to the bus bar 10, a resilient U-shaped protective cover 34 is provided having a base portion that is connected with the bus bar 10, and a pair of leg portions that extend downwardly on opposite sides of the insulation-piercing contact 8.

Arranged for rotation within cam recesses 14 contained in the upper portion of the terminal block housings 7 are a plurality of eccentric disks 16, respectively, said disks containing axially-aligned radially-offset openings 17. Extending through these aligned offset openings is a support shaft 37 the ends of which are supported by opposed openings 36 contained in the side walls 3*a* of the frame 3. The side walls of the terminal housings 7 contain opposed vertical slots 18 through which the support shaft 37 extends. The eccentric disks 16 also carry at each end central axially-extending pegs 32 that extend within corresponding opposed slots 33 contained in the side walls of the housing 7. Also mounted on the operating disks are spring-biased retaining buttons 53 that are arranged to engage corresponding stop openings 54*a* and 54*b* contained in the housing side walls when the terminal blocks are in their elevated and lowered positions, as will be described below. The housing 7 contains a first access opening 12 for receiving the first output conductor 70*a*, and a second access chamber 35 for receiving the connector of the second output conductor 70*b*.

Figure 6:
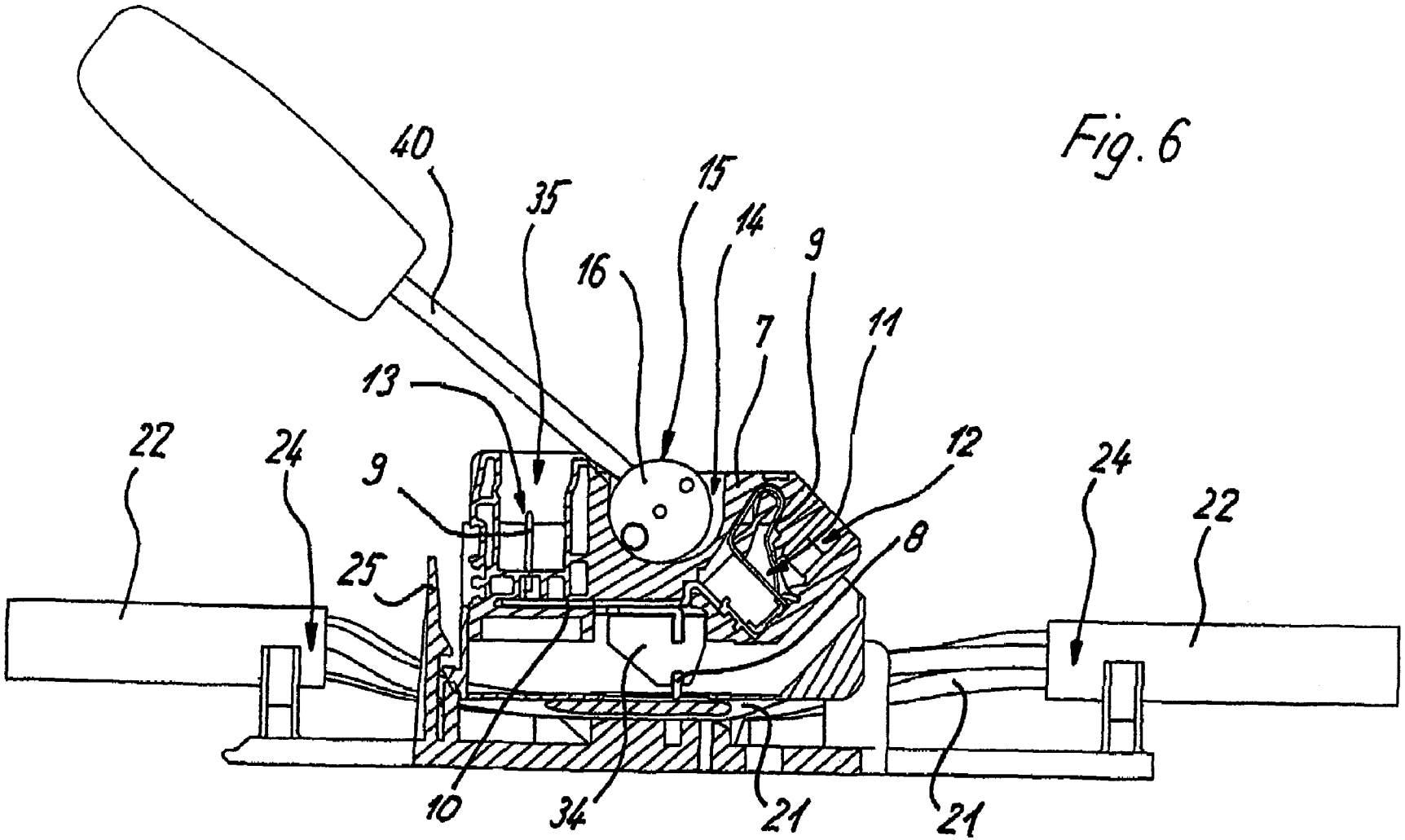
FIGS. 6 and 7 are longitudinal sectional views illustrating the manner of operation of the apparatus to displace the frame and terminal block assembly from the elevated inoperable position to the lowered insulation-piercing position, respectively.
Figure 7:
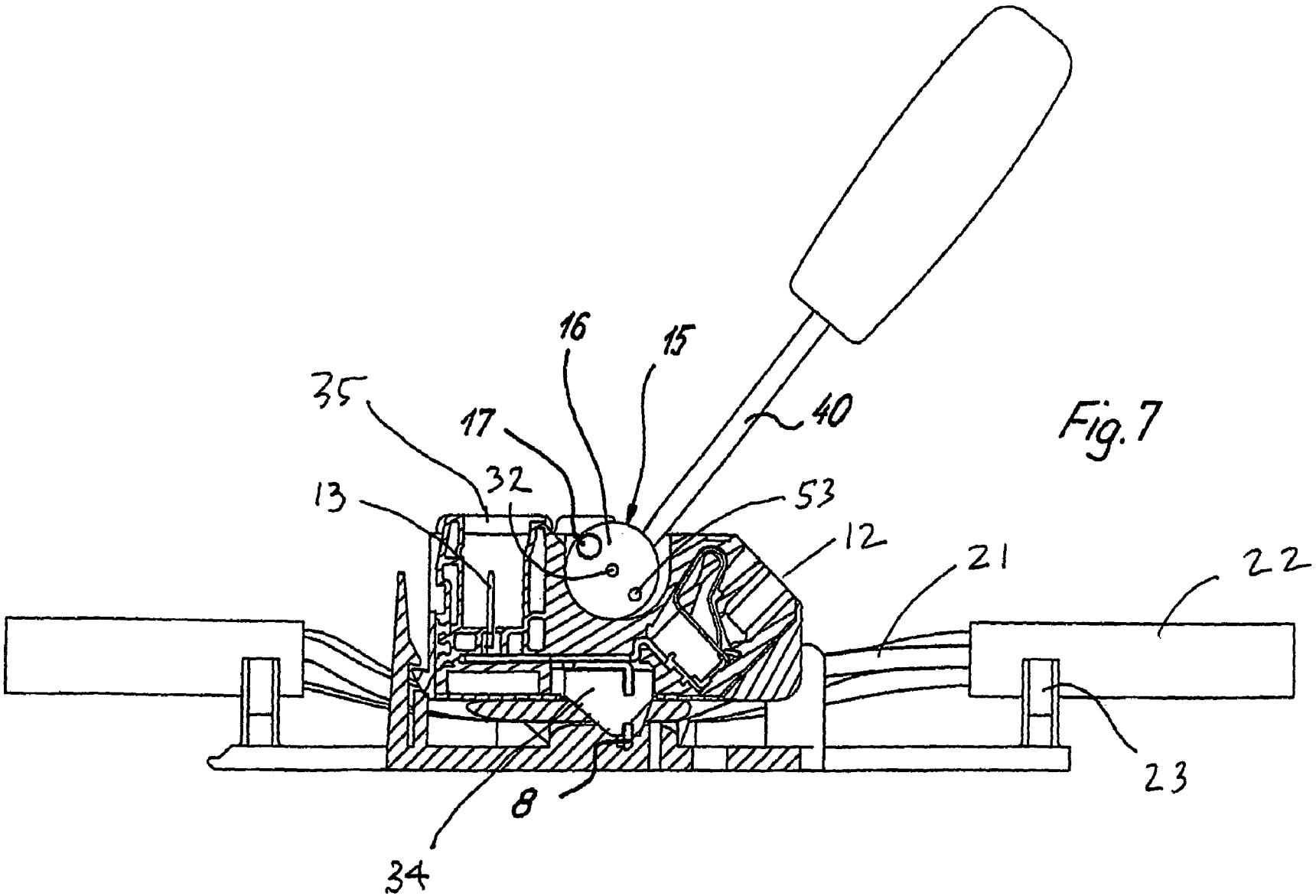

Referring now to FIG. 6, once the assembly of the frame 3 and the terminal blocks 4 is lowered onto the base member 2, the tip of an operating tool such as a screwdriver 40 is inserted within a corresponding slot 42 contained in the outer periphery of the eccentric disk 16, whereupon the disks 16 are simultaneously rotated about the support shaft 37 that extends through the opening 17 contained in the eccentric disks, and the vertical slots contained in the side walls of the terminal blocks. Owing to the cooperation between the outer circumferential cam surface of the eccentric disk 16 and the adjacent wall surface of the cam recess 14, together with the forces produced by the axially-extending pegs 32 extending through the slots 33 contained in the side walls of the housing 7, the frame assembly is displaced downwardly relative to the base member 2 from the elevated inoperative position of FIG. 3 to the lower operable position of FIG. 7. At this time, the knife edges of the bifurcated fork piercing member 8 sever the insulation layer of the associated conductor 21, whereupon the conductor within the insulated conductor is electrically connected with the first and second contact means 9*a* and 9*b* at opposite ends of the terminal block. The retaining button 53 on the opposite ends of the eccentric disk 16 then engages the corresponding position-establishing opening 54*b* (FIG. 2*b*), thereby to maintain the eccentric disks 16 in place relative to the terminal blocks upon removal of the operating tool 40.

The support shaft 37 is normally non-rotatably connected with the eccentric disks 16, whereby the eccentric discs are operated simultaneously as a unit. Alternatively, the disks could be rotatably mounted on the shaft for individual selective operation. The base member 2 contains a row of inspection openings 30 beneath the conductors 21, respectively, thereby to permit an observer to determine if the conductors are properly in place. The base member also includes a plurality of vertically projecting integral mounting studs 25 to which the frame 3 is fastened when mounted on the base member 2, as shown in FIGS. 3 and 4. Catch fasteners at the upper ends of the vertical projections 25 engage corresponding catch projections on the frame 3 when it is lowered to the mounted position of FIG. 4.

To disengage the frame and terminal block assembly from the base member 2, the operating tool 40 is again introduced into the slot 42, whereupon the eccentric disks 16 are rotated in the counterclockwise direction to their initial disengaged positions of FIG. 6. In this state, the retaining button 53 on each eccentric disk 16 engages the position-defining opening 54*a* contained in the side walls of the terminal block housing 7. The engagement between the retaining button 53 and each of the position-defining openings 54*a* and 54*b* produces an audible sound.

Figure 8:
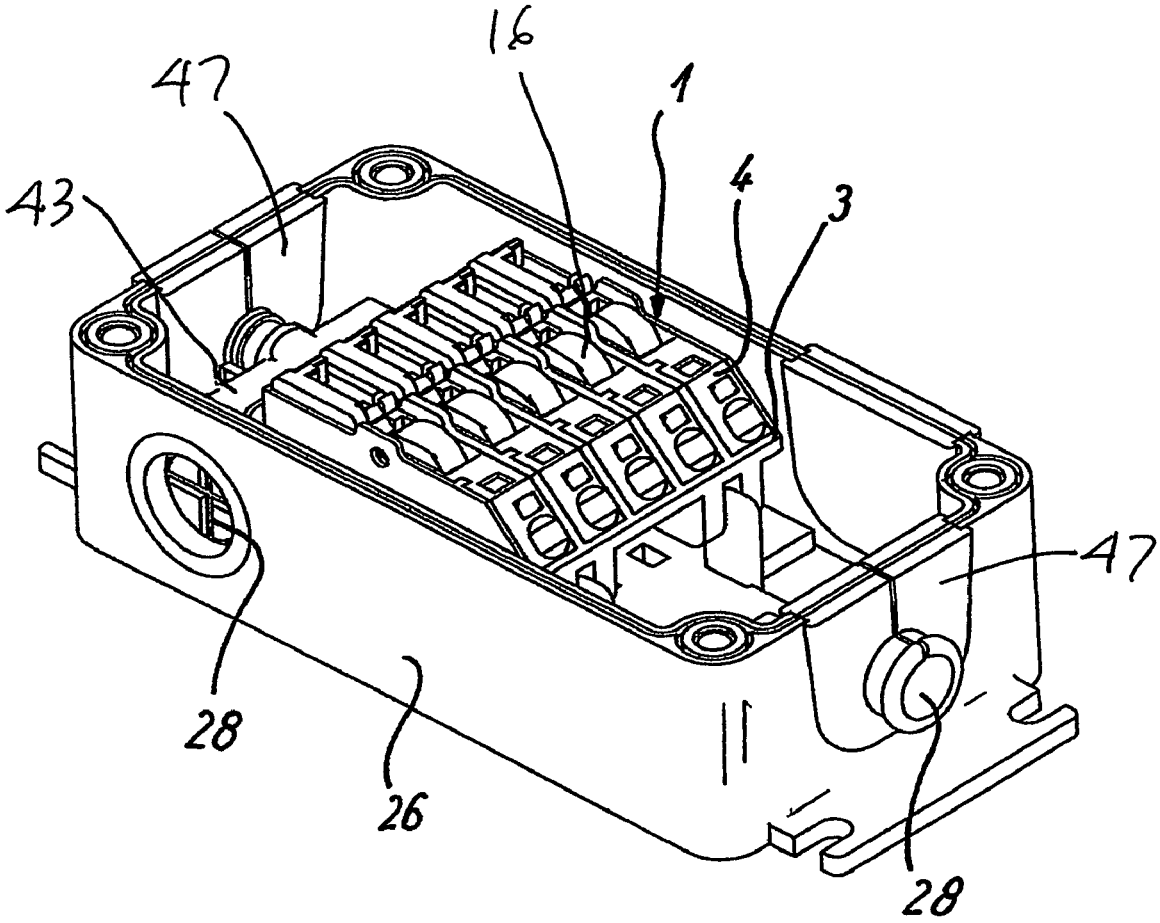
FIGS. 8 and 9 illustrate a modification of the apparatus of FIG. 4 contained within the outer housing with the lid removed and with the lid added, respectively.
Figure 9:
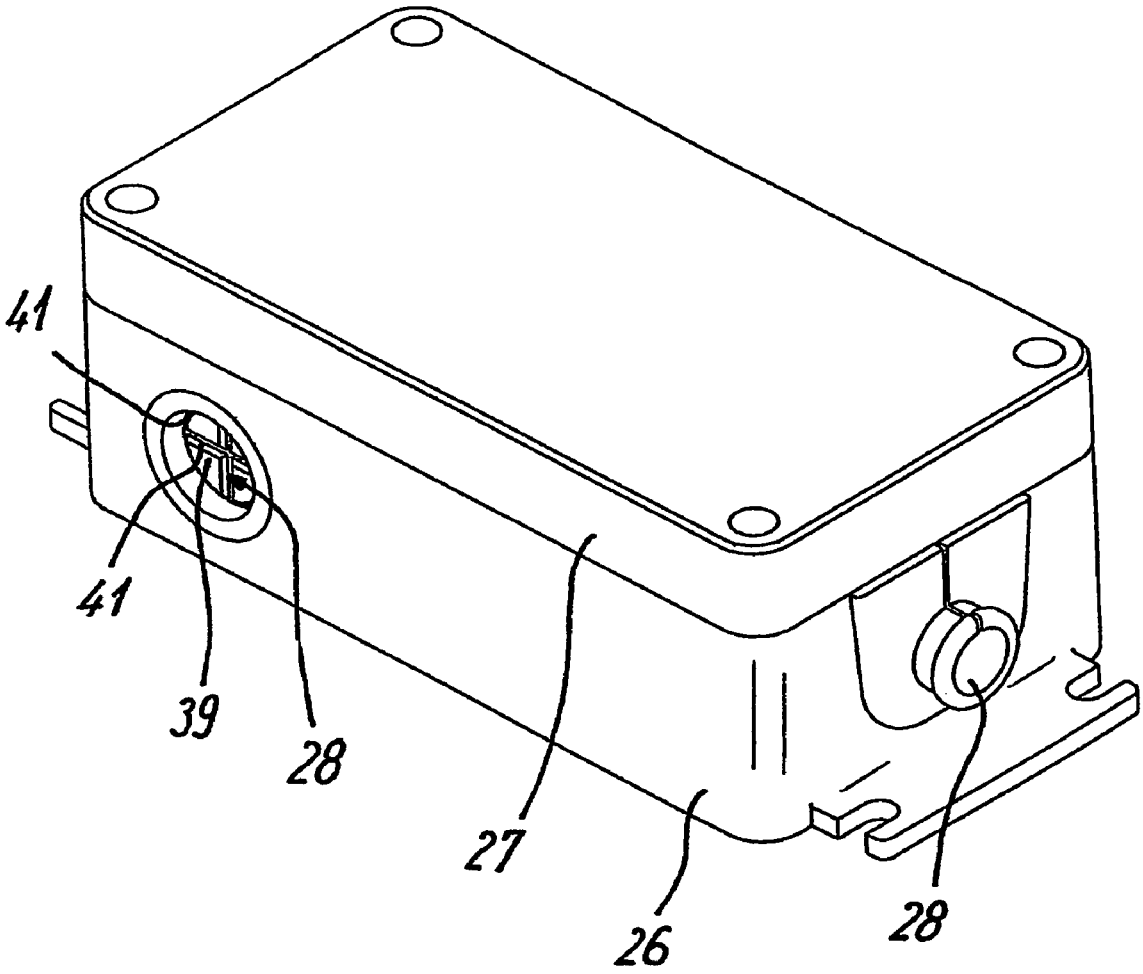
Figure 10:
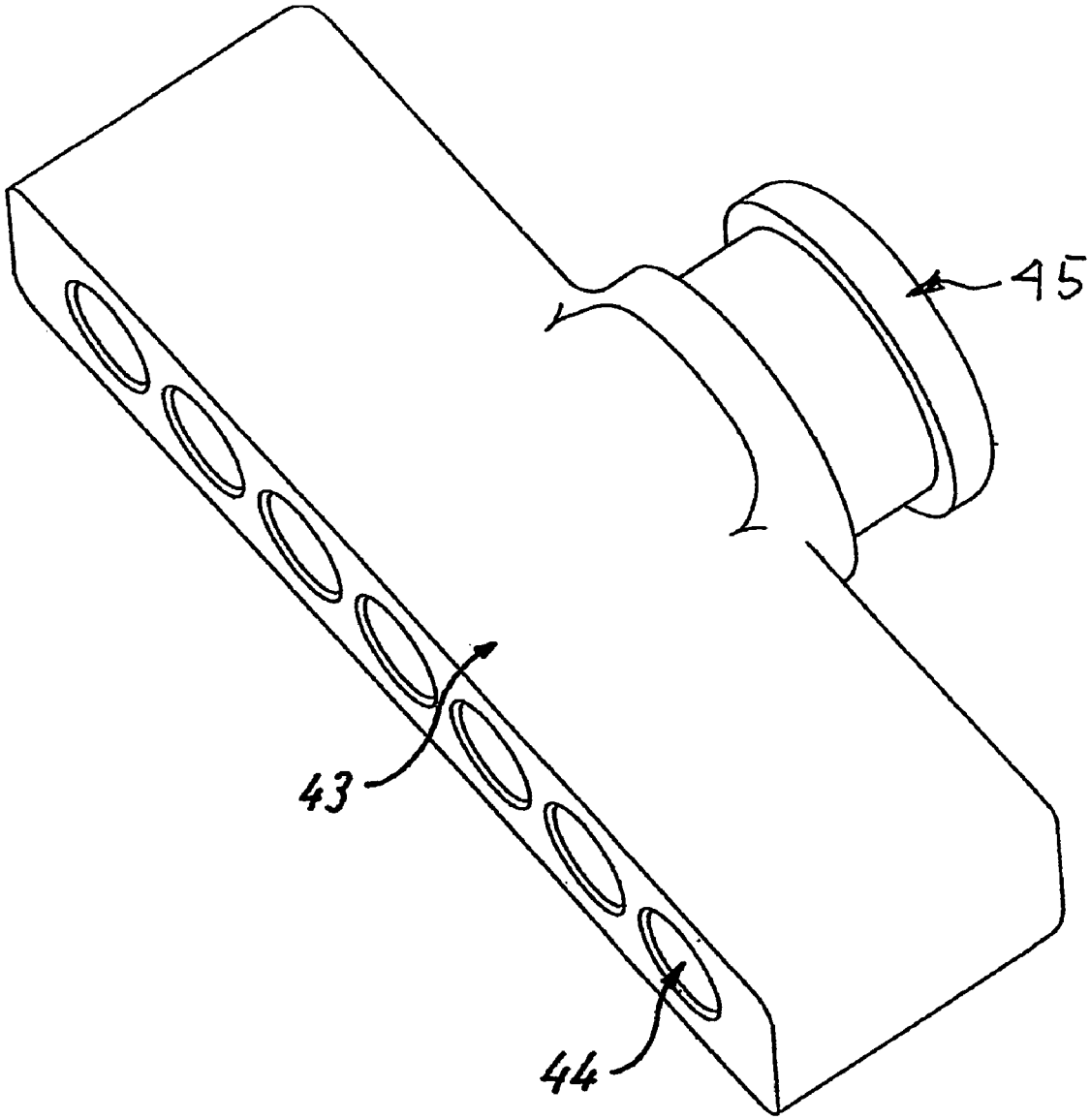
FIG. 10 is a perspective view of the cable-to-conductor separating means of FIG. 8.
Figure 11:
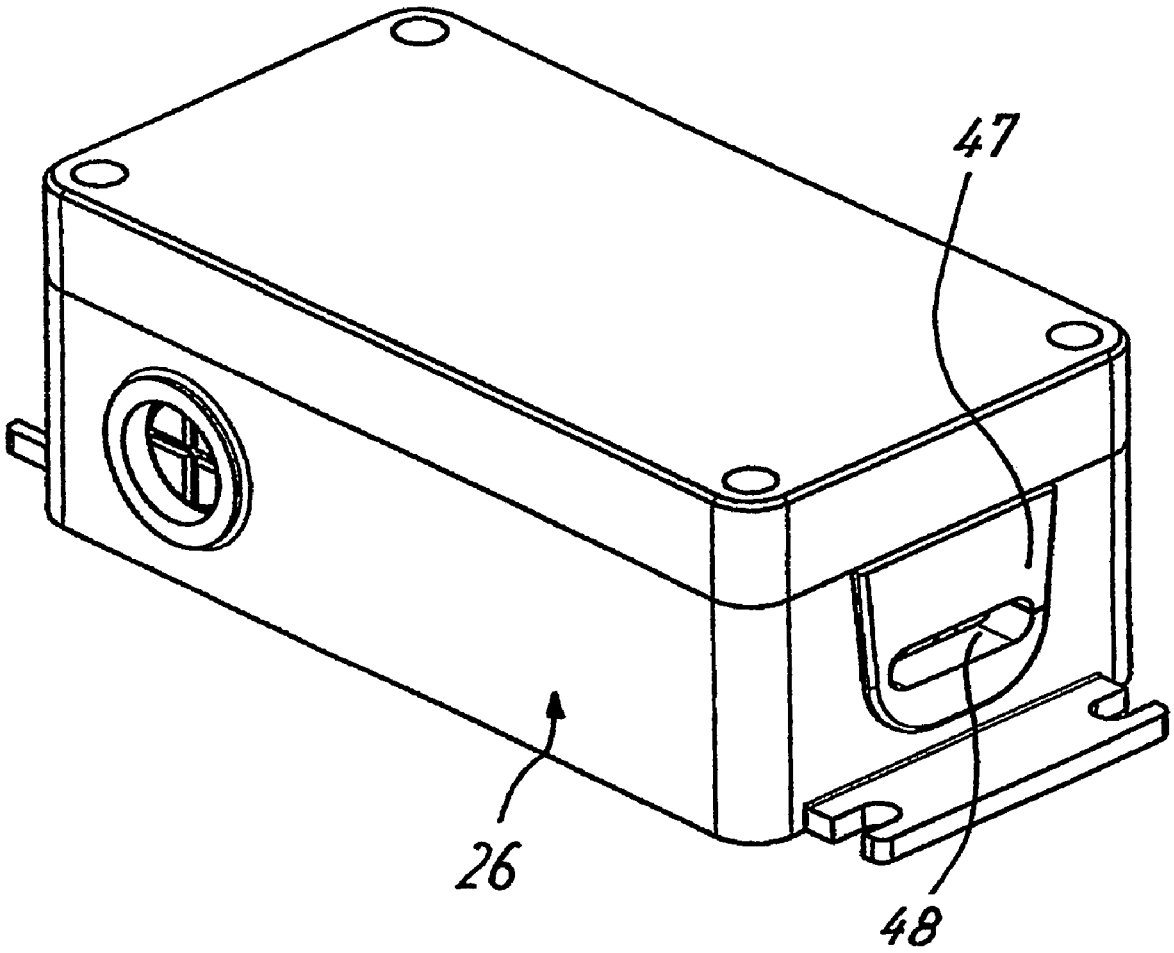
FIG. 11 is a perspective view of a modification of the housing arrangement of FIG. 9.

Referring now to FIGS. 8 and 9, following the mounting of the frame and terminal block assembly on the base member 2, the resulting assembly is inserted downwardly within the chamber contained within an outer housing 26, with the cable extending through resilient seals mounted in the end walls of the outer housing 26. The output conductors 70 are directed out of the chamber of the outer housing 26 via a lateral opening 28 contained in the opposed side walls of the outer housing 26. The seal that normally closes the opening 28 is fractured to permit the output conductors to extend there through. If desired, a cable support element 43 (FIG. 10) may be provided containing a circular opening 45 at one end for receiving the cable 22, and a plurality of openings 44 for receiving the respective insulated conductors 21. The lower housing element 26 is closed by an upper lid closure member 27, as shown in FIG. 9. In the modification of FIG. 11, the opening 48 contained in the seal member 47 at each end of the housing 26 has an oval configuration for receiving a flat cable having a plurality of insulated conductors enclosed with an outer sheath layer.

Figure 12:
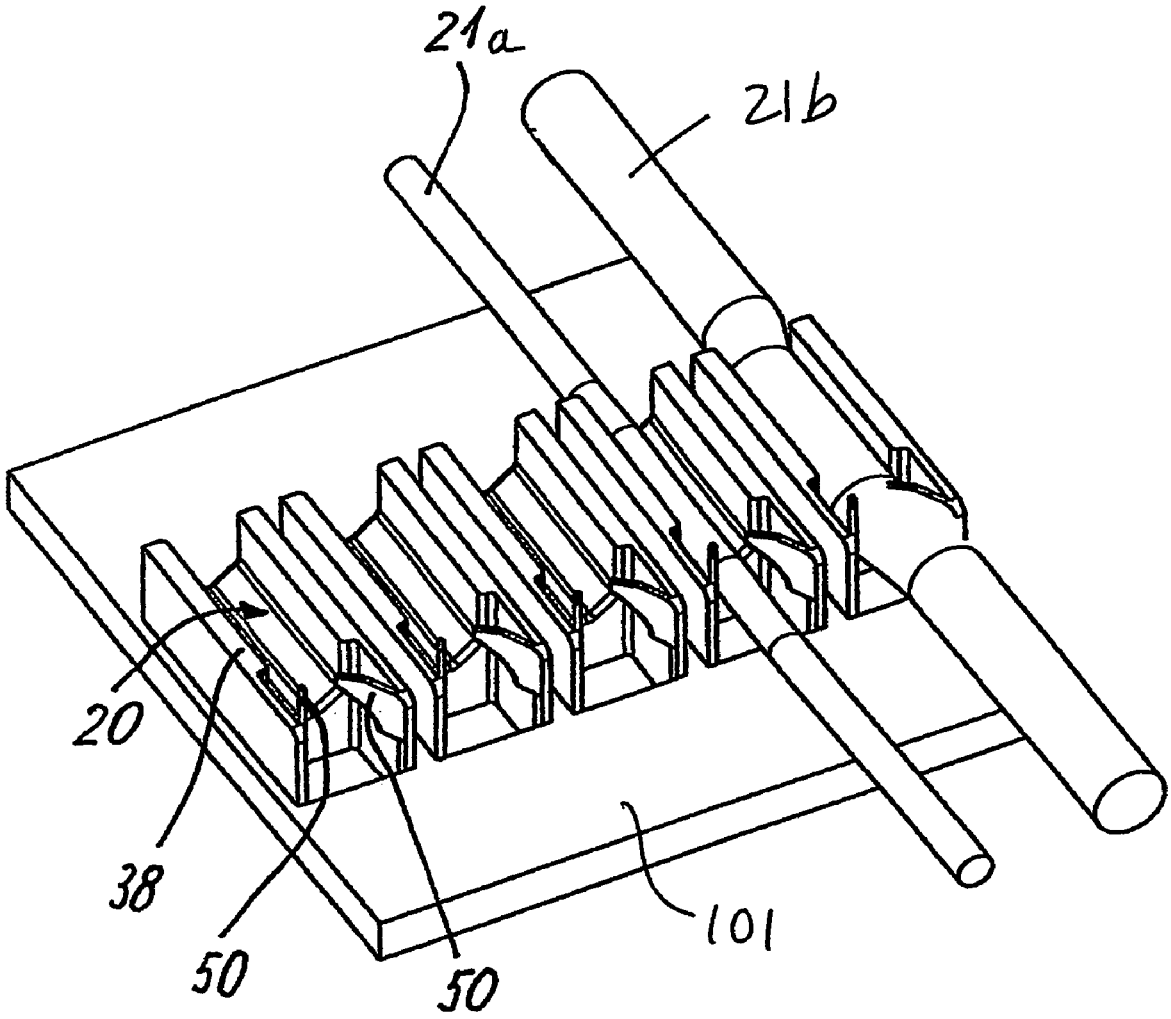
FIGS. 12-14 are perspective views illustrating base members having various conductor seat arrangements.
Figure 13:
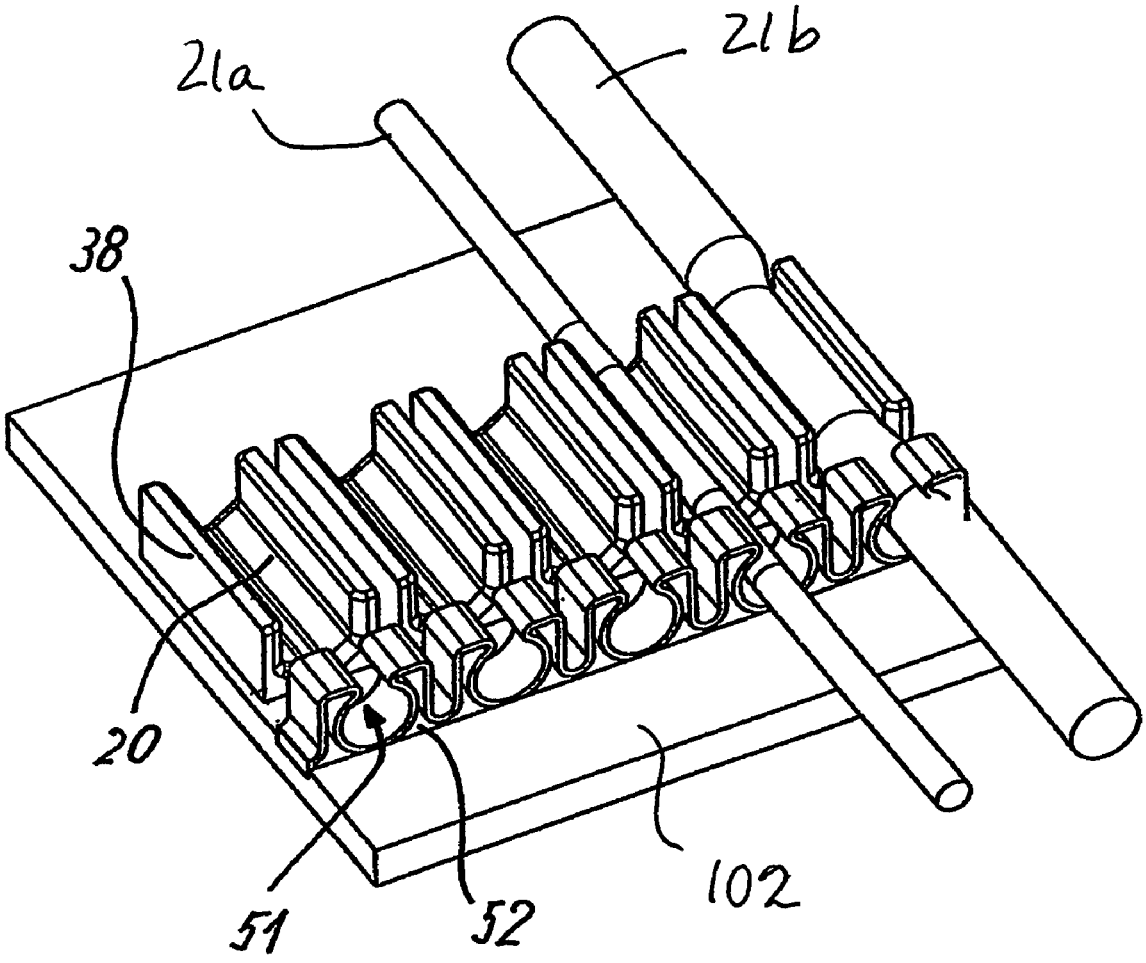
Figure 14:
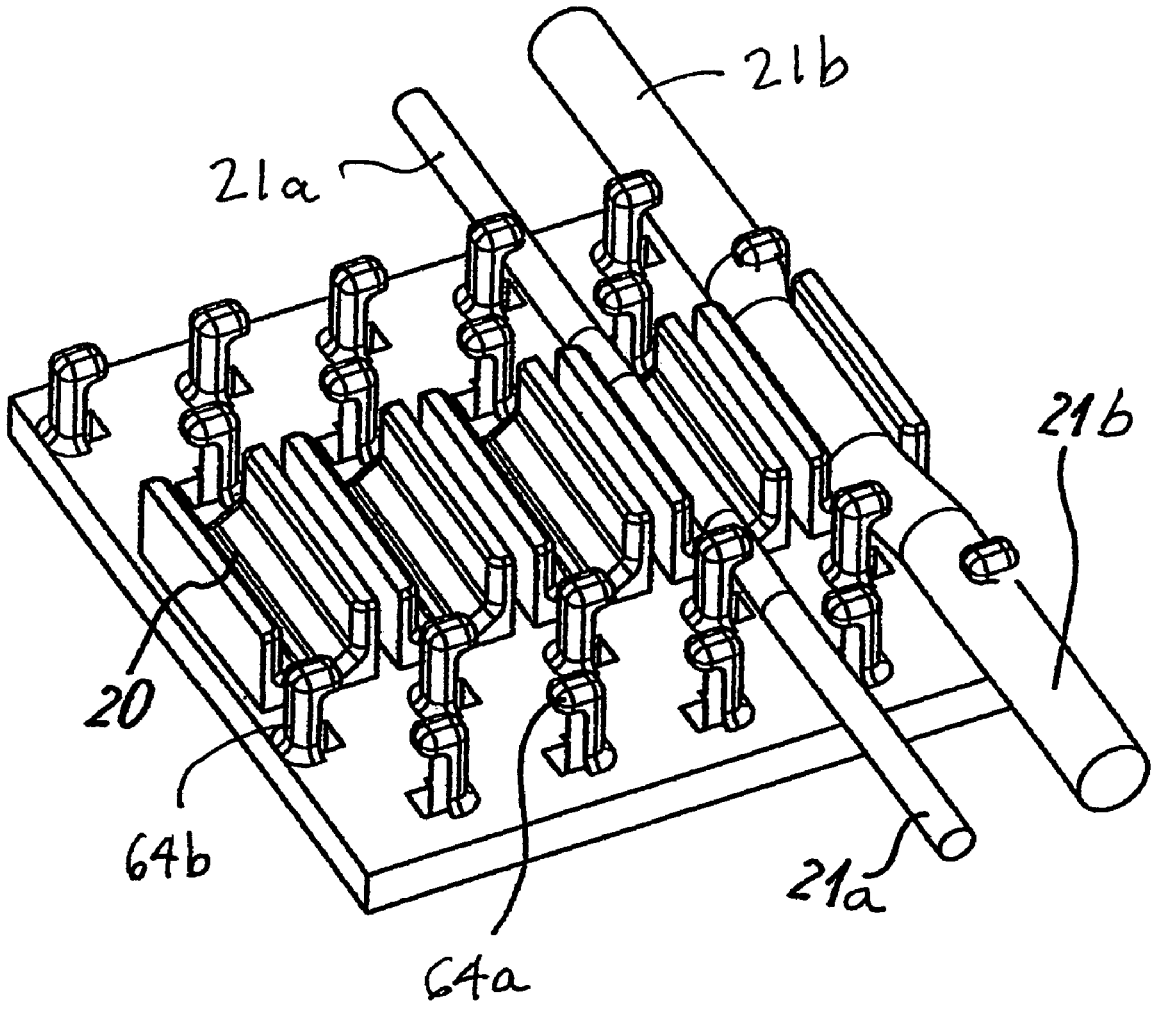

Referring to FIGS. 12-14, the connector apparatus may include base members having various configurations and constructions. In the embodiment of FIG. 12, the base member 101 is provide with a plurality of conductor seats 20 that are adapted to receive conductors 21*a* and 21*b* having different diameters, respectively. The raised sides of the seats define bridge members 38 are provided with catch hooks 50 that retain conductors 21*a* and 21*b* of different diameters in the insulated conductor seats. In the embodiment of FIG. 13, the conductors are retained in separate elastic catch seats 51 that are mounted on a bridge 52 that is fastened to the upper surface of the base member 102. In the embodiment of FIG. 14, the projection 64*a* and 64*b* are arranged in parallel rows and face in opposite directions, thereby to define a labyrinth arrangement for retaining the cables 21*a* and 21*b* of different diameters within the conductor seats 20.

In the embodiment of FIG. 1, the assembly of the rectangular frame 3 and terminal blocks 4 is mounted upon the base member 2 by cooperating snap fastener means on the vertical projections 25 and the corresponding surfaces at the four corners of the frame 3. In the second embodiment of FIGS. 15, 16*a*, and 16*b*, the frame and terminal block assembly 1' is fastened to the base member 104 by means of pivot lugs 58 that extend from the rear wall of the rectangular frame 3' into a corresponding recess (not shown) contained in the base member 104, whereupon the frame and terminal block assembly is pivoted from an initial inclined position downwardly about the pivot lug means 58 toward the horizontal position parallel with the base member, thereby to effect engagement between catches 3*d'* that extend outwardly from the side walls of the frame into corresponding catch openings contained in the vertical protecting portions 25'.

Figure 15:
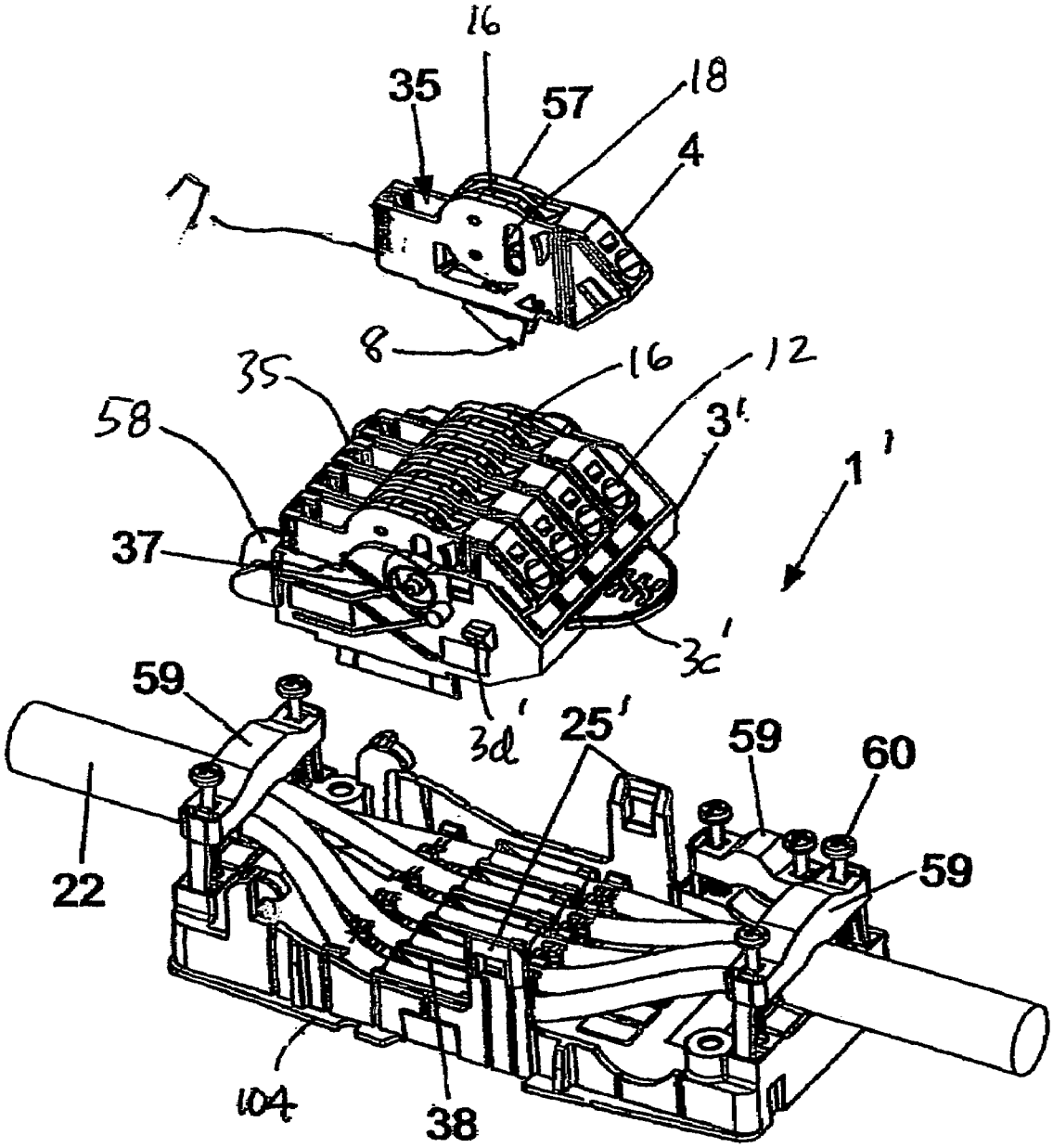
FIG. 15 is an exploded view of a modification of the apparatus of FIG. 1.
Figures 16A, 16B:
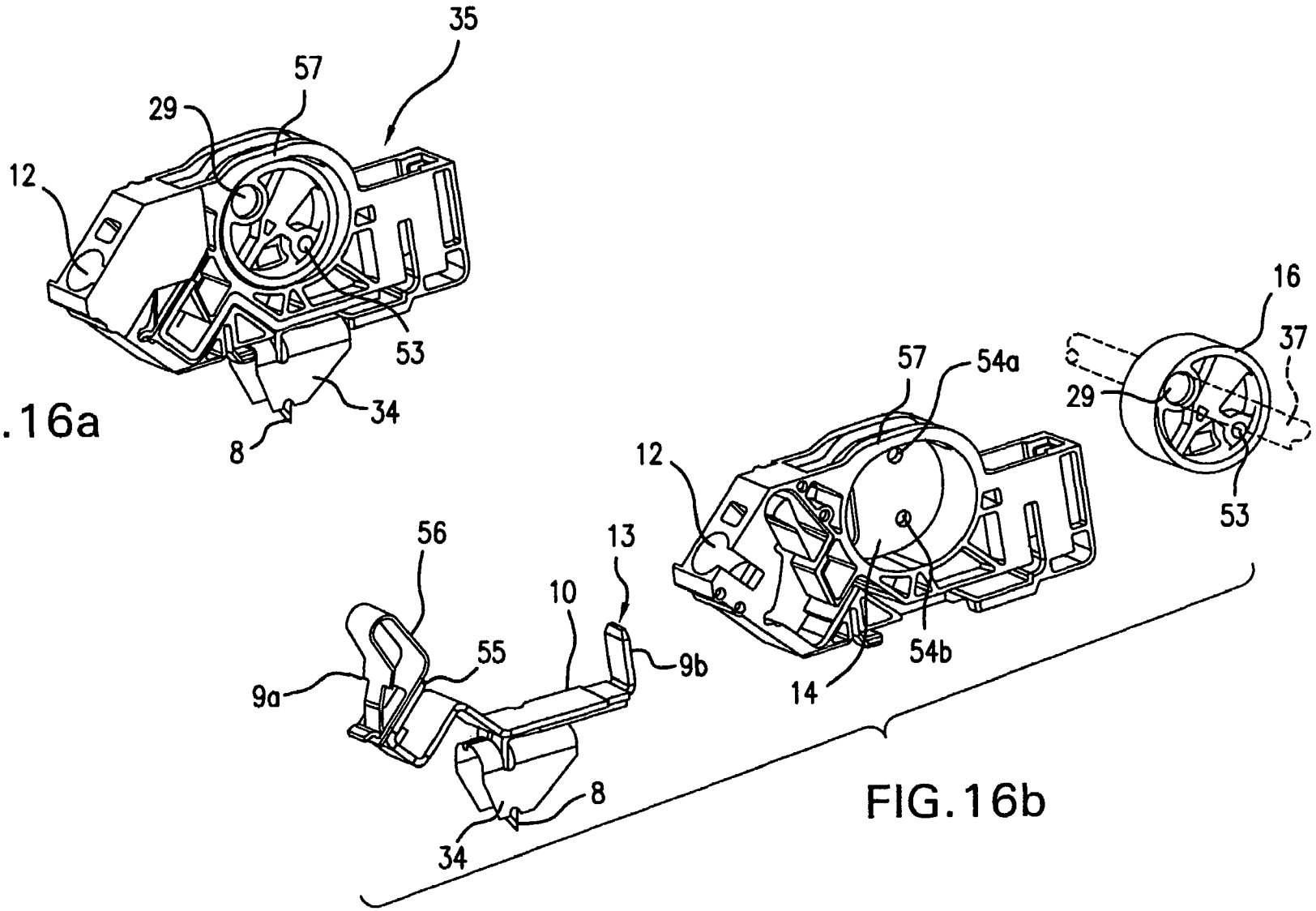
FIG. 16*a* is a rear perspective view of the terminal block of FIG. 15.
FIG. 16*b* is an exploded view of the terminal block of FIG. 16*a;*
Figure 17:
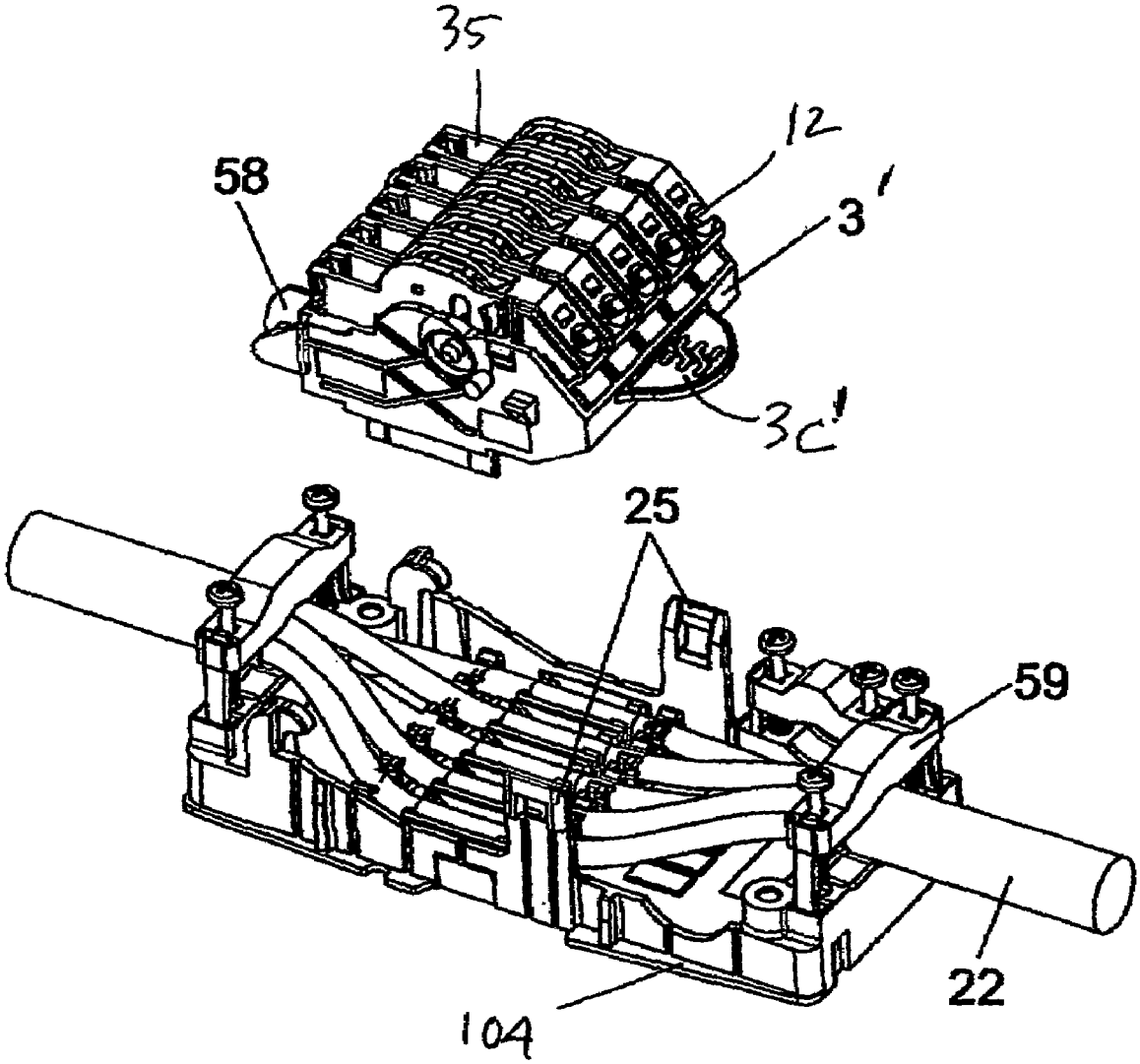
FIG. 17 is a perspective view of a partially assembled connector arrangement corresponding to FIG. 15.
Figure 18:
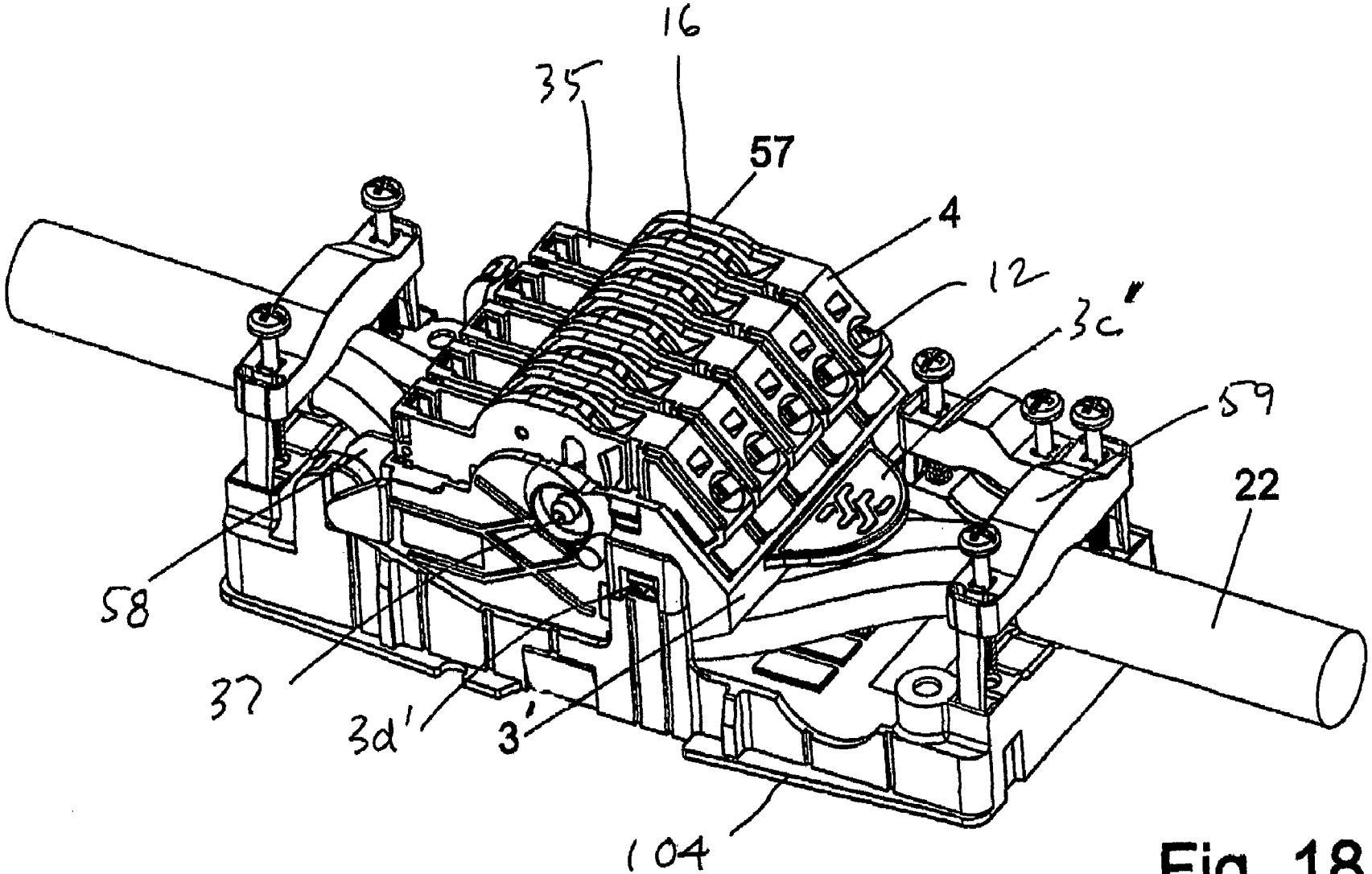
FIGS. 18 and 19 are perspective views illustrating the assembled apparatus of FIG. 15 with the terminal blocks in the elevated inoperative and lowered operative insulation-piercing positions, respectively.
Figure 20:
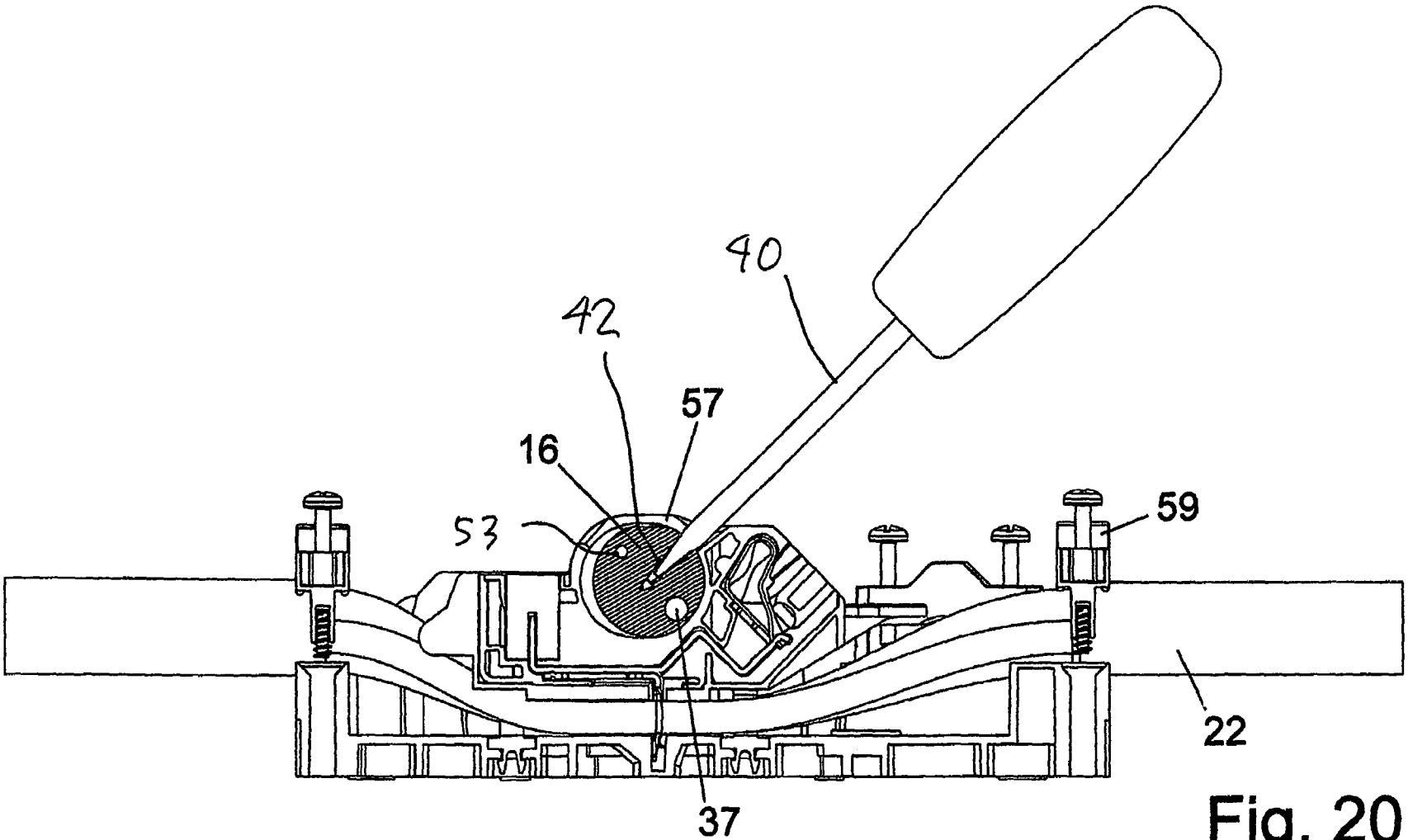
FIGS. 20 and 21 are longitudinal sectional views illustrating the operation of the apparatus of FIG. 15 when in the lowered operative and elevated inoperative positions, respectively.
Figure 21:
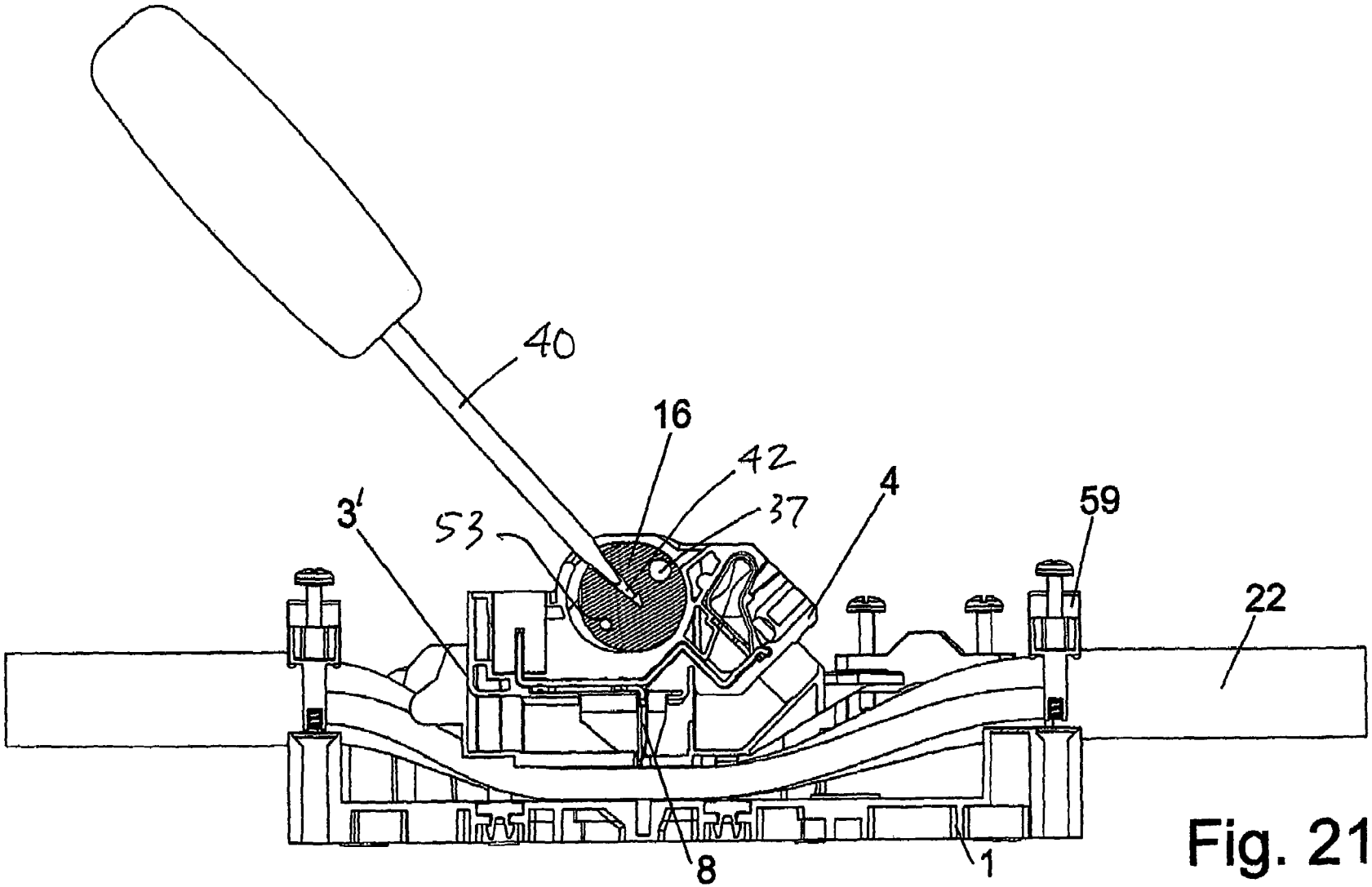

Referring to FIGS. 15 and 16, it will be seen that the side walls of the terminal block housing 7 have upper bridge portions 57 that enclose the end portions of the eccentric disks 16. As before, each disk 16 contains an offset opening 29 that is non-rotatably connected with the support shaft 37. The retaining button 53 mounted on each eccentric disk 16 is operable to engage audibly the corresponding position openings 54*a* and 54*b* when the frame and terminal block assembly is in its elevated disengage and lowered engaged positions, respectively. The bus bar arrangement for connecting the piercing contact 8 with the output contacts 9*a* and 9*b* is the same in this embodiment as in the first embodiment of FIG. 1. Thus, when the eccentric disk 16 of FIG. 21 is rotated by the tool 40 in the clockwise direction about the axis of support shaft 37 to the position shown in FIG. 20, terminal blocks are displaced downwardly to effect piercing of the insulation layer by the fork 8. In this embodiment, clamping means including clamping bar 59 and clamping screw 60 are provided for clamping the cable 22 to the bottom wall member 104. As before, the continuous support shaft 37 is non-rotatably connected with all of the eccentric disks, whereby the operating disks are displace as a unit. Of course, if desired, the eccentric disks 16 of the embodiments of FIGS. 1 and 15 could be rotatably connected with the support shaft 37, whereupon the terminal blocks 4 could be individually displaced relative to the base member, rather than being displaced simultaneously as a group.

Figure 19:
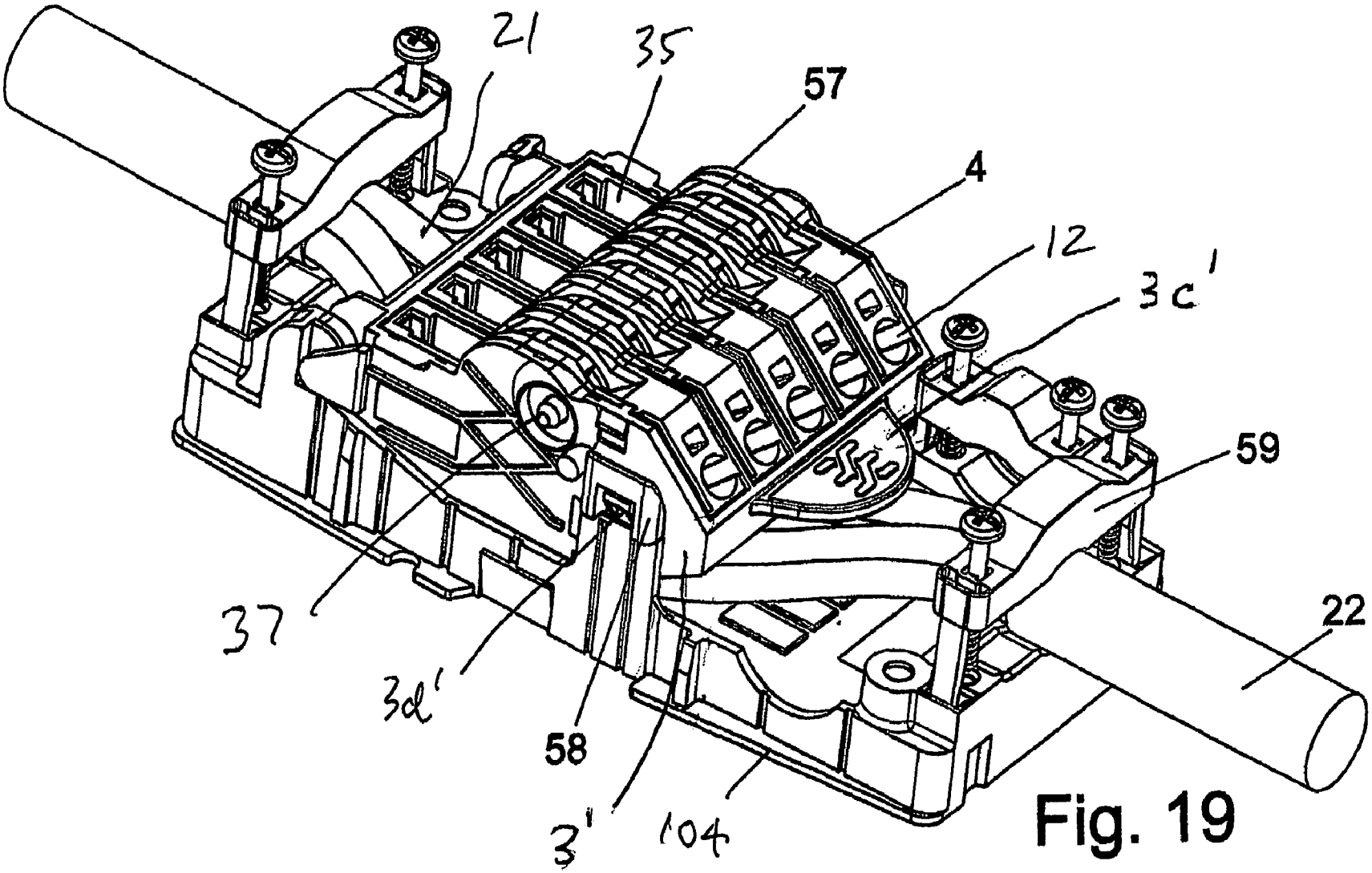
Figure 22:
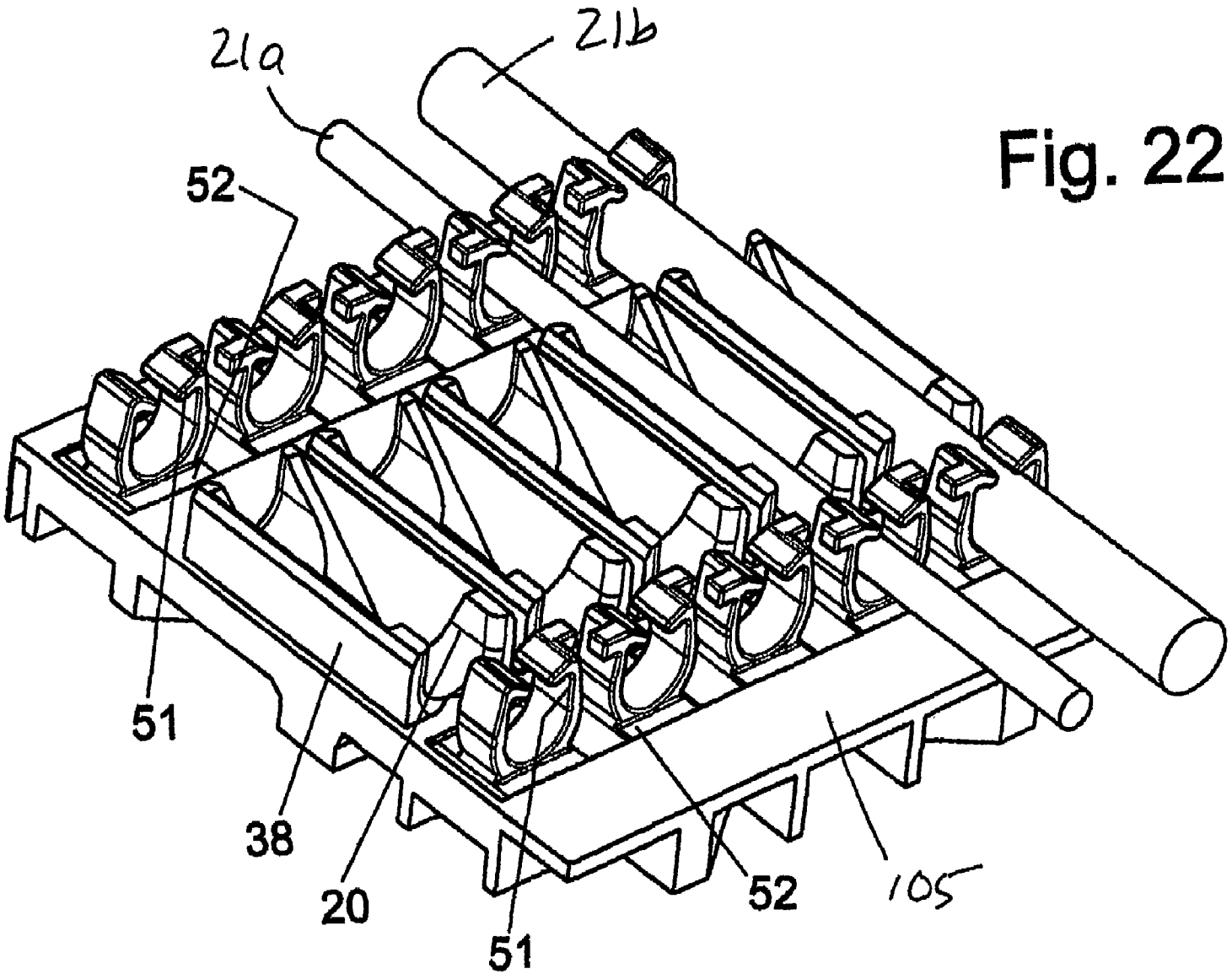
FIG. 22 is a perspective view of another modification of the base member conductor seat arrangement.
Figure 23:
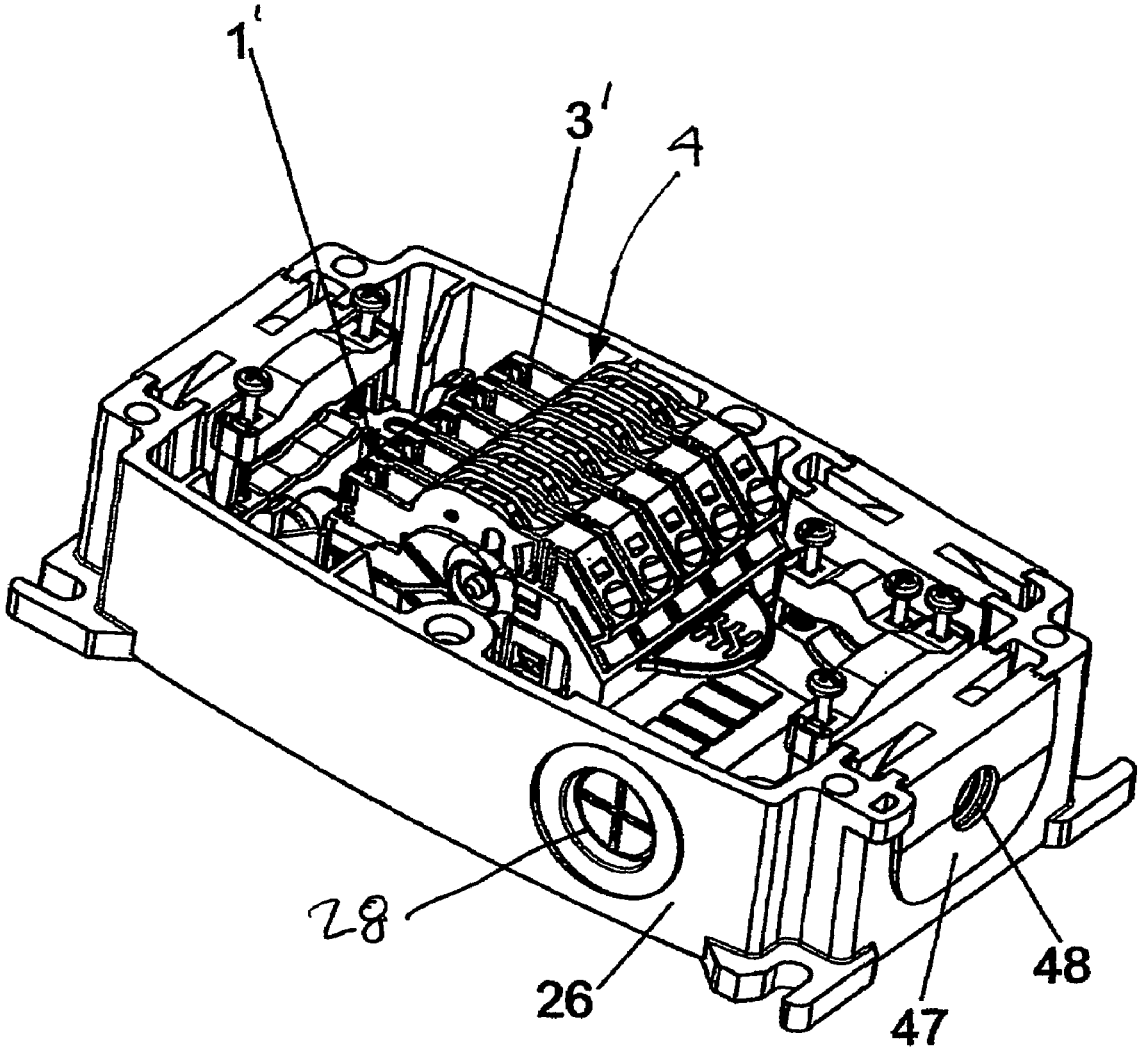
FIG. 23 is a perspective view of the apparatus of FIG. 16 mounted within the lower housing section, with the lid removed.
Figure 24:
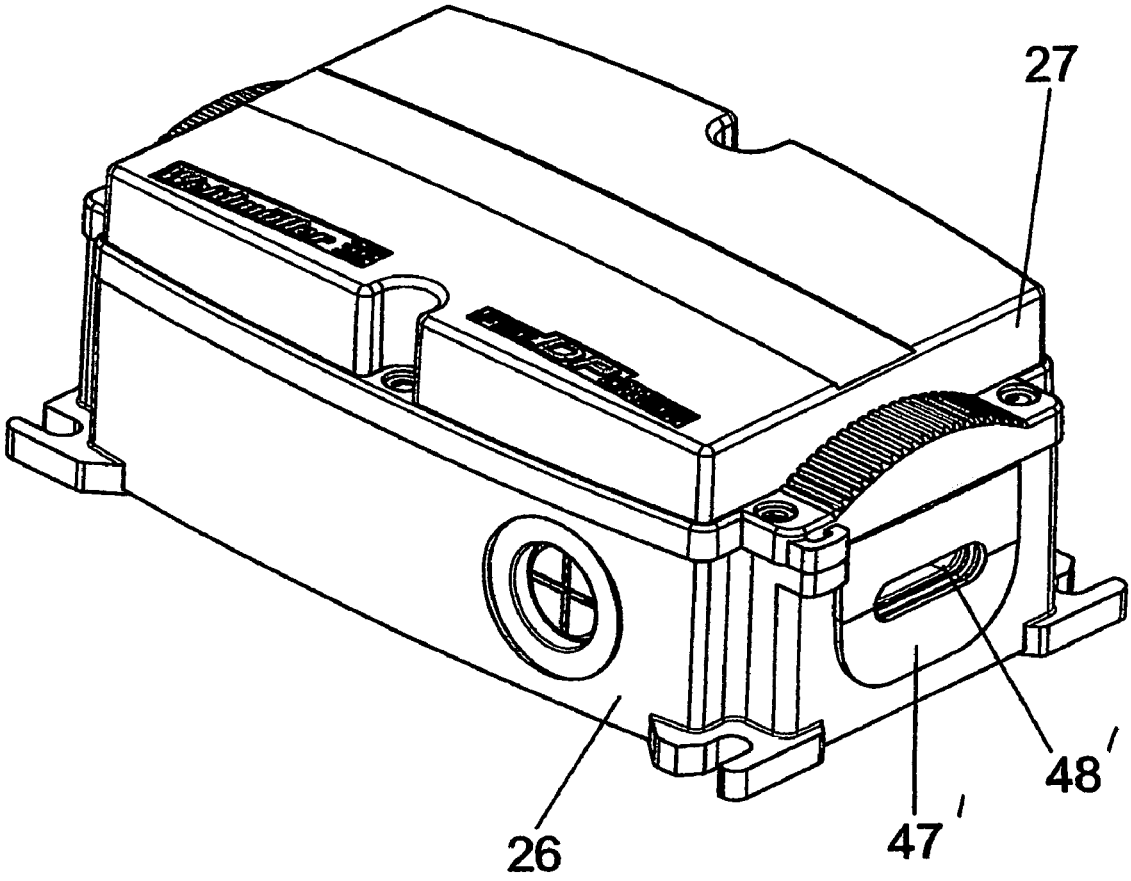
FIGS. 24 and 25 are perspective views of various modifications of the housing of FIG. 23.
Figure 25:
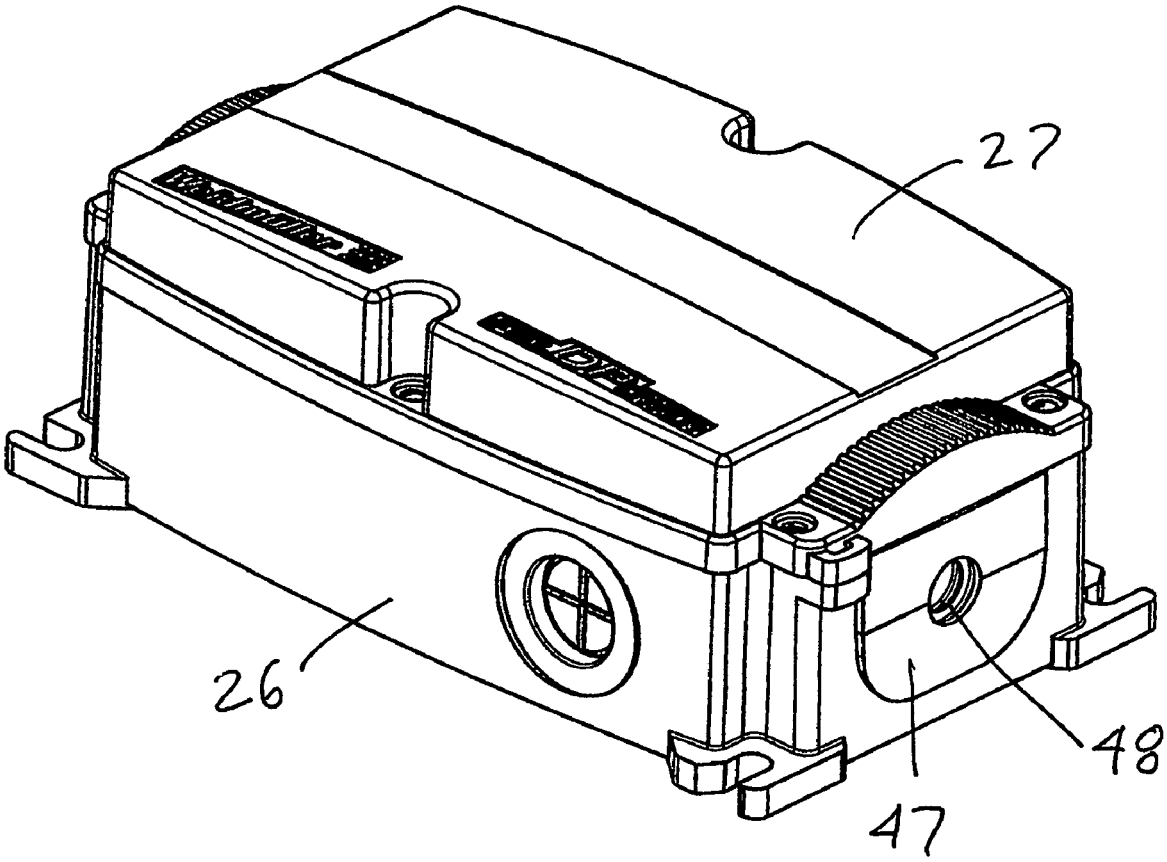

Referring now to FIG. 22, the base member embodiment 105 includes resilient supports 51 for retaining conductors 21*a* and 21*b* of different diameters within their respective longitudinally-extending conductor seats 20. In the embodiment of FIG. 23, the apparatus of FIG. 19 is mounted within the chamber contained in the lower section 26 of an outer housing. At each end, the housing lower section 26 is provided with an opening in which is mounted seal means 47 containing a circular opening 48 for receiving the cable 22. In the modification of FIG. 24, the opening 48' contained in seal means 47' has an oval configuration for receiving a flat cable. The housing lower section 26 is closed by a lid closure member 27, as shown in FIGS. 24 and 25.

Figure 26A:
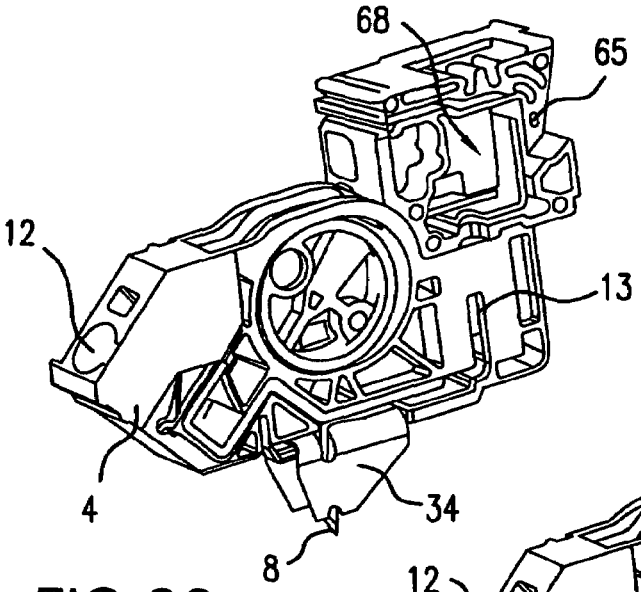
FIGS. 26*a,* 26*b* and 26*c* are partially assembled, fully assembled, and exploded perspective views, respectively, of another terminal block embodiment.
Figure 26B:
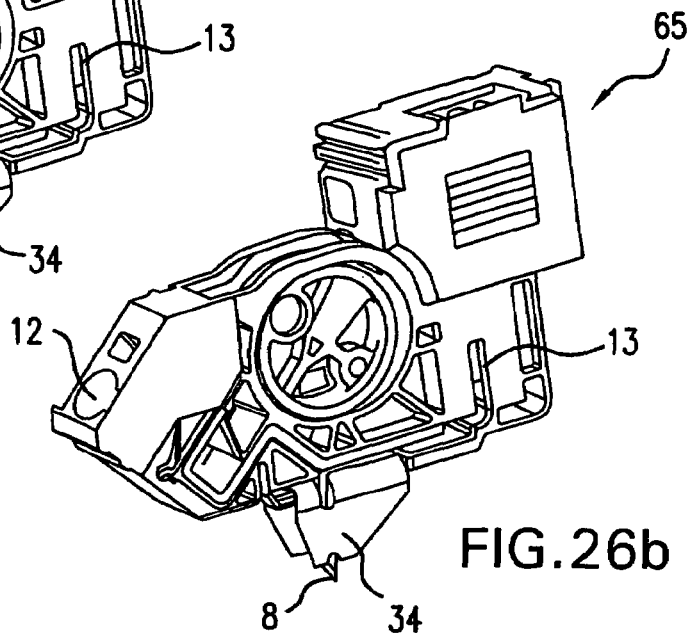
Figure 26C:
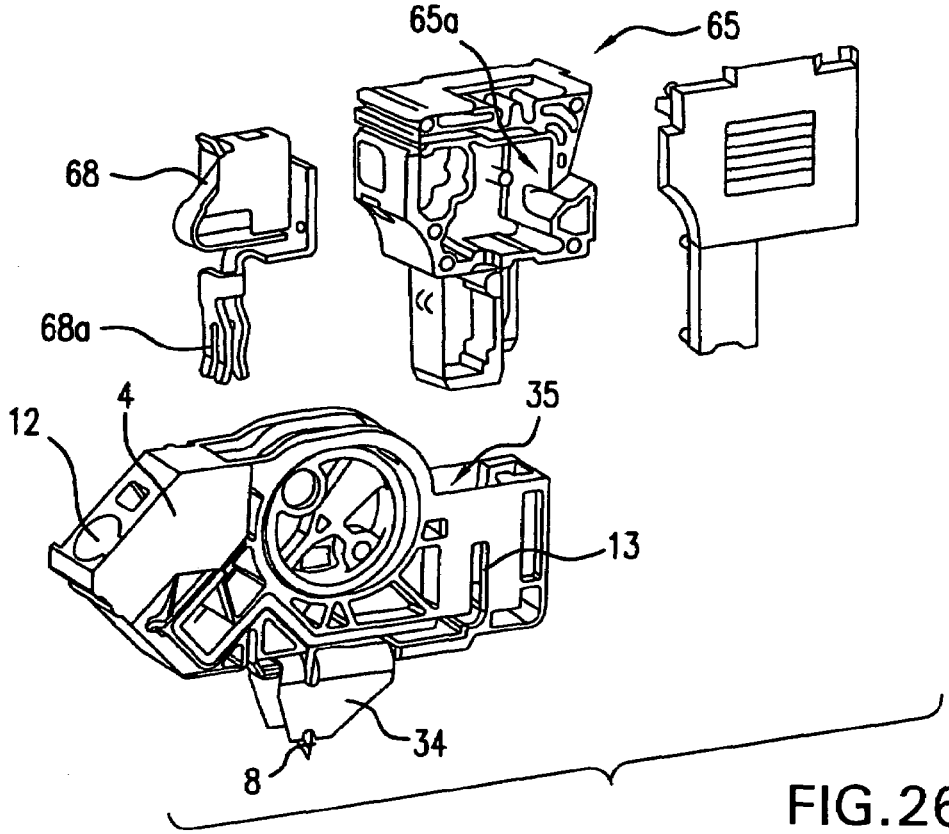
Figure 27B:
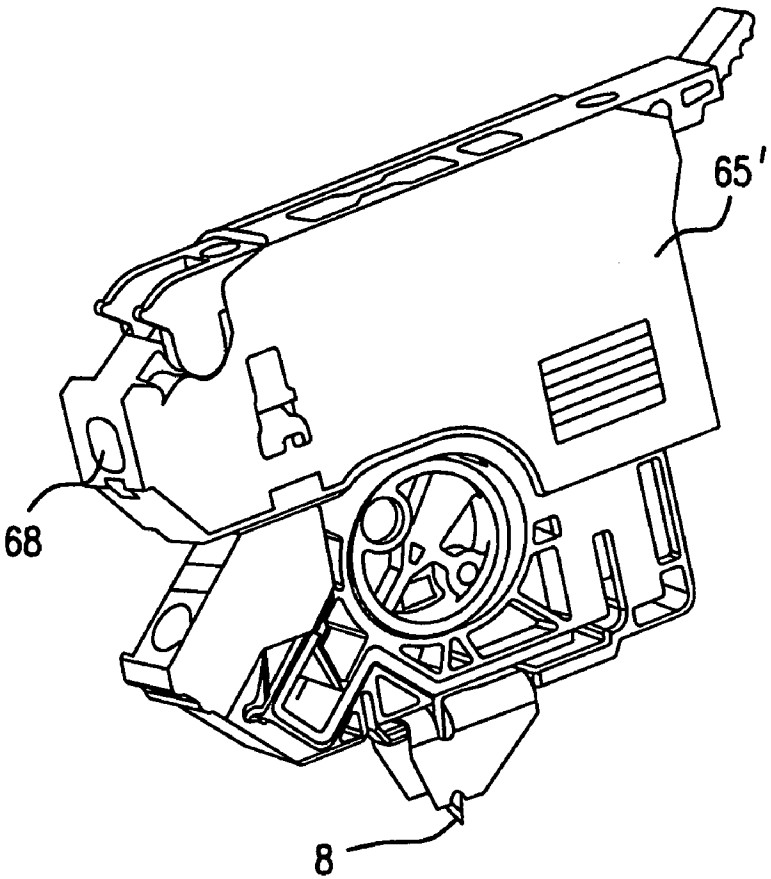
FIGS. 27*a,* 27*b* and 27*c* are partially assembled, fully assembled, and exploded perspective views, respectively, of a further terminal block embodiment.
Figure 27A:
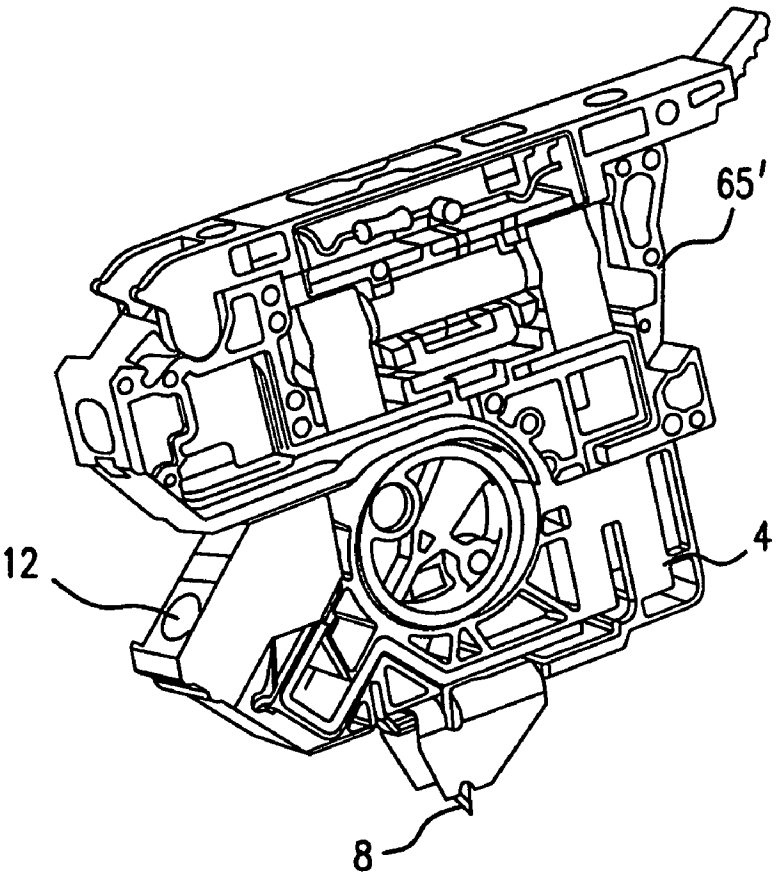
Figure 27C:
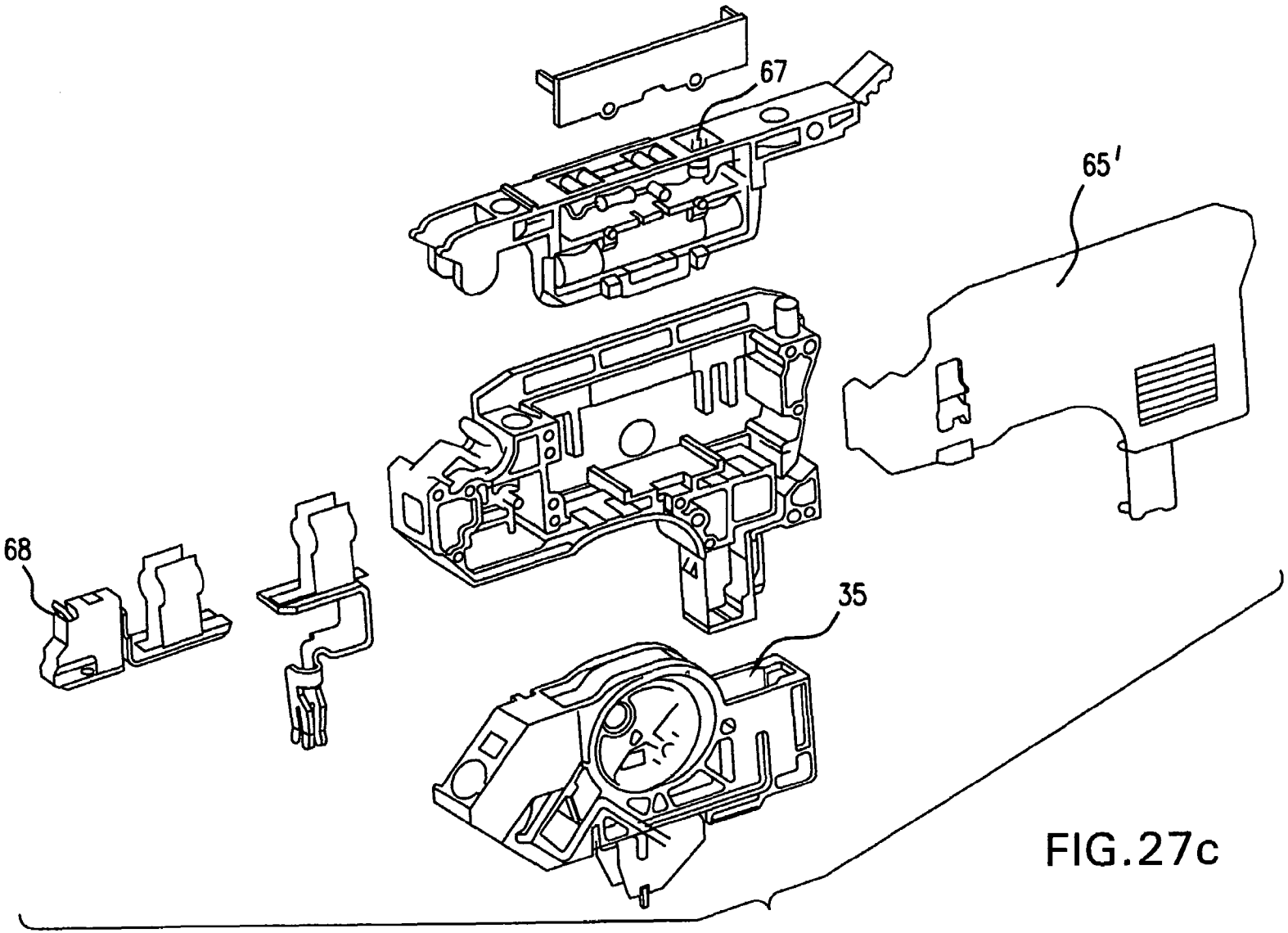

Referring now to FIGS. 26*a*, 26*b*, and 26*c*, it will be seen that the output connector plug 65 that extends within access opening 35 containing the vertical plug contact 13 includes a chamber 65*a* that receives a conductive bifurcated contact 68 having a downwardly extending bifurcated lower end 68*a* that is adapted to receive the upwardly projecting plug contact 13 when the plug 65 is inserted within the access opening 35, as shown in FIG. 26*a*. As shown in FIG. 27*a*-27*c*, an auxiliary electrical component 67 may be connected with the vertical plug contact 13 thereby to supply current from the insulation piercing contact 8 to a plurality of output conductors connected with the plug 65'.

While in accordance with the provisions of the Patent Statutes the preferred forms and embodiments of the invention have been illustrated and described, it will be apparent to those skilled in the art that changes may be made without deviating from the invention described above.

What is claimed is:

1. An electrical connector arrangement for supplying to a plurality of output conductors (70) current that is tapped off from a plurality of insulated input conductors (21), respectively, comprising:

(a) a rectangular base member (2) having a horizontal upper surface containing a plurality of longitudinally-extending conductor seats (20) for supporting the insulated input conductors, respectively;

(b) a rigid hollow rectangular support frame (3, 3') mounted on said base member upper surface and surrounding the space above said conductor seats, said frame having spaced pairs of side and end walls, said frame being formed from an electrical insulating material and contains a plurality of longitudinal chambers (6) extending parallel with and above said conductor seats, respectively, the upper and lower ends of said chambers being open;

(c) a plurality of rectangular terminal blocks (4) mounted for vertical movement with in said frame chambers above and parallel with said conductor seats, respectively, each of said terminal blocks including:

(1) a hollow housing (7);

(2) at least one output terminal (9) mounted in said housing adjacent an access opening contained in said housing; and (3) an insulation-piercing contact (8) connected with said output terminal and extending downwardly from said housing; and (d) displacement means (16) for displacing said terminal blocks between elevated disengaged positions spaced above said conductor seats, and lowered engaged positions in which the insulation-piercing contacts are arranged to pierce the insulation layers and electrically engage the input conductors supported by the associated seats, respectively.

2. The electrical connector arrangement as defined in claim 1, and further including vertical guide rib and means (69) guiding said terminal blocks for vertical movement relative to said frame.

3. The electrical connector arrangement as defined in claim 1, and further including fastening means for fastening said frame to said base member.

4. The electrical connector arrangement as defined in claim 3, wherein said fastening means comprises:

(1) a plurality of spaced stud members (25) integral with and extending upwardly from said base member; and (2) snap fastener means connecting said stud members with said frame.

5. The electrical connector arrangement as defined in claim 4, wherein said frame (3') includes at one end at least one pivot lug (58) that extends horizontally outwardly from said for cooperation with a corresponding pivot support opening contained in said base member, thereby to permit pivotal movement of said frame from a disengaged position toward an engaged position relative to said base member, said stud members and said snap fastener means being operable to connect the other end of said frame with said base member.

6. The electrical connector arrangement as defined in claim 5, wherein said other end of said frame includes an operating tab (3*c*') for pivoting said frame between said engaged and disengaged positions relative to said frame.

7. The electrical connector arrangement as defined in claim 1, wherein said terminal block displacement means comprises:

(1) a support shaft (37) mounted between the side walls of and extending transversely across said frame;

(2) a plurality of axially spaced eccentric operating disks (16) associated with said terminal blocks, respectively, said operating disks containing aligned radially-offset eccentric axial openings (17; 29) that receive said support shaft, said operating disks having outer circumferential cam surfaces that extend within corresponding cam recesses (14) contained within said terminal blocks, respectively, each of said cam chambers having a pair of opposed planar side walls, and a curved cam wall surface that cooperates with the circumferential cam surface on the associated operating disk such that rotation of said operating disk produces vertical displacement of the terminal block between said disengaged and engaged positions relative to said frame.

8. The electrical connector arrangement as defined in claim 7, and further including:

(e) releaseable catch means (53, 54) for retaining each of said operating disks in said engaged and disengaged positions relative to said terminal block side walls.

9. The electrical connector arrangement as defined in claim 8, wherein said releaseable catch means comprises a spring-biased retaining button (53) carried by said operating disk for engagement with corresponding catch openings (54*a*, 54*b*) contained in the terminal block recess side walls, said retaining button and catch openings being operable upon engagement to produce an audible sound.

10. The electrical connector arrangement as defined in claim 7, wherein each of said operating disks includes a pair of centrally arranged guide pegs (32) that extend axially outwardly into corresponding guide slots (33) contained in the cam recess side walls.

11. The electrical connector arrangement as defined in claim 7, wherein said cam recess side walls have bridging portions (57) that enclose the end portions of said operating disks, respectively, whereby the cam surfaces at each end of the cam recess are continuous.

12. The electrical connector arrangement as defined in claim 7, wherein said eccentric disks are non-rotatably connected with said support shaft, whereby said terminal blocks are displaced simultaneously between said disengaged and engaged positions, respectively.

13. The electrical connector arrangement as defined in claim 7, wherein said eccentric disks are rotatably mounted on said support shaft, whereby said terminal blocks are independently displaceable between said disengaged and engaged positions, respectively.

14. The electrical connector arrangement as defined in claim 1, wherein two of said output terminals (9*a*, 9*b*) are provided within said terminal block adjacent corresponding access openings (12, 35), respectively, and further including a bus bar (10) electrically connecting said output terminals, whereby current tapped off from one input insulated conductor is supplied to two output conductors.

15. The electrical connector arrangement as defined in claim 14, wherein one of said output terminals (9*a*) comprises a quick-fastening resilient bent contact (56) arranged for engagement with the bare end of an associated output conductor (70*a*).

16. The electrical connector arrangement as defined in claim 14, wherein one of said output terminals comprises a male stud contact (13) arranged for engagement with a plug connector (65).

17. The electrical connector arrangement as defined in claim 14, and further including contact support means (34) supporting each of said insulation-piercing contacts relative to the associated bus bar.

18. The electrical connector arrangement as defined in claim 17, wherein said contact support means comprises a generally U-shaped resilient member (34) having a base portion connected with said bus bar, and a pair of leg portions that extend downwardly on opposite sides of and in engagement with said insulation-piercing contact.

19. The electrical connector arrangement as defined in claim 1, wherein said base member contains a plurality of inspection openings (30) arranged adjacent said insulated conductor seats, respectively.

20. The electrical connector arrangement as defined in claim 1, wherein the insulated conductors are contained within an insulating sheath to define a cable (22), a section of the cable sheath being removed to expose the insulated conductors (21) that extend between the associated sheath ends (24), said base member including at each end cable support means (23; 59) for supporting the cable on opposite sides of said insulated conductor seats.

21. The electrical connector arrangement as defined in claim 20, and further including retaining means (50; 51; 64) mounted on said base member for retaining insulated conductors of different diameters in their respective conductor seats.

22. The electrical connector arrangement as defined in claim 21, wherein said retaining means includes catch means (50) mounted on the walls of said insulated conductor seats.

23. The electrical connector arrangement as defined in claim 21, wherein said retaining means includes a plurality of U-shaped resilient support devices (51) mounted on said base member adjacent said seats, respectively.

24. The electrical connector arrangement as defined in claim 21, wherein said retaining means comprises a plurality of vertical studs (64) that extend in a labyrinth pattern upwardly from said base member top surface.

25. The electrical connector arrangement as defined in claim 20, and further including a rectangular outer housing containing a chamber receiving said base plate with the frame and terminal blocks mounted thereon, said housing being sectional and including lower housing section (26), and a removable upper lid section (27) closing said lower housing section, said main body section having a pair of opposed end walls containing end wall openings (48, 48') for receiving the cable, and a side wall containing an opening (28) for receiving the output conductors.

26. The electrical connector arrangement as defined in claim 25, and further including a hollow insulated conductor spreading unit (43) mounted between one of said end wall openings and said base member, said spreading unit having a first wall containing a first opening (45) for receiving the cable, and an opposite wall containing a plurality of second openings (44) for receiving the insulated conductors, respectively.

* * * * *